US009187286B2

(12) United States Patent
Maeda et al.

(10) Patent No.: US 9,187,286 B2
(45) Date of Patent: Nov. 17, 2015

(54) FOLDING DEVICE

(75) Inventors: Kenji Maeda, Kanagawa (JP); Kenji Inoue, Chiba (JP)

(73) Assignee: Kabushiki Kaisha Tokyo Kikai Seisakusho (JP)

( * ) Notice: Subject to any disclaimer, the term of this patent is extended or adjusted under 35 U.S.C. 154(b) by 741 days.

(21) Appl. No.: 13/314,975

(22) Filed: Dec. 8, 2011

(65) Prior Publication Data

US 2012/0165173 A1 Jun. 28, 2012

(30) Foreign Application Priority Data

Dec. 24, 2010 (JP) ..... 2010-287423
Aug. 25, 2011 (JP) ..... 2011-184128

(51) Int. Cl.
*B31B 1/16* (2006.01)
*B65H 45/16* (2006.01)

(52) U.S. Cl.
CPC ..... *B65H 45/168* (2013.01); *B65H 45/164* (2013.01); *B65H 45/165* (2013.01)

(58) Field of Classification Search
CPC ..... B31F 1/08; B31F 1/10; B42C 1/00; B41F 13/58; B31B 1/14; B31B 1/16; B65H 45/163–45/166; B65H 45/168; B65H 45/28
USPC ..... 493/356, 429, 424–426, 476, 428, 432; 270/49, 50
See application file for complete search history.

(56) References Cited

U.S. PATENT DOCUMENTS

| | | | | | |
|---|---|---|---|---|---|
| 2,335,431 | A | * | 11/1943 | Meyer | 270/43 |
| 4,381,106 | A | * | 4/1983 | Loebach | 270/47 |
| 4,946,151 | A | * | 8/1990 | Liebert | 270/47 |
| 5,065,993 | A | | 11/1991 | Reponty | |
| 5,676,630 | A | * | 10/1997 | Mayr | 493/424 |
| 6,165,118 | A | * | 12/2000 | Eckert | 493/425 |
| 6,331,154 | B1 | * | 12/2001 | Shibuya et al. | 493/424 |
| 6,932,755 | B2 | * | 8/2005 | Teshima et al. | 493/434 |
| 7,771,335 | B2 | * | 8/2010 | Wingate et al. | 493/356 |
| 2007/0135286 | A1 | * | 6/2007 | St. Ours et al. | 493/424 |
| 2008/0064583 | A1 | | 3/2008 | Belleculee et al. | |

FOREIGN PATENT DOCUMENTS

| | | |
|---|---|---|
| CN | 101148115 | 3/2008 |
| DE | 10 2005 017 232 | 10/2006 |
| JP | 2000-505768 | 5/2000 |
| JP | 2008-056493 | 3/2008 |
| WO | 98/18705 | 5/1998 |

* cited by examiner

*Primary Examiner* — Gloria R Weeks
*Assistant Examiner* — Justin Citrin
(74) *Attorney, Agent, or Firm* — Clark Hill PLC

(57) ABSTRACT

This folding device 1 comprises: a folding blade mechanism operation control mechanism 16 for operating a folding blade mechanism 13C provided in a folding cylinder 13; and a paper edge holding mechanism operation control mechanism 15 for operating a paper edge holding mechanism 13B provided in the folding cylinder 13, the folding blade mechanism operation control mechanism 16 and the paper edge holding mechanism operation control mechanism 15 being provided capable of activation based on a predetermined activating signal.

4 Claims, 11 Drawing Sheets

FOLDING DEVICE

CROSS-REFERENCE TO RELATED APPLICATIONS

The present application relates to subject matter contained in Japanese Patent Applications No 2010-287423, filed on Dec. 24, 2010 and No. 2011-184128, filed on Aug. 25, 2011, all of which is expressly incorporated herein by reference in its entirety.

BACKGROUND OF THE INVENTION

1. Field of the Invention

The present invention relates to a folding device that cuts a continuous paper into sheets and folds the sheets formed by cutting the continuous paper, more specifically, to a folding device comprising a cutting mechanism and a folding cylinder and capable of collect folding that overlaps the sheets on a circumferential surface of the folding cylinder and folds the overlapped sheets.

2. Description of the Related Art

Disclosed in, for example, Patent Documents 1 and 2 identified below is a folding device capable of "collect folding", comprising a cutting mechanism and a folding cylinder that are driven to rotate. The folding device cuts a continuous paper into sheets by a cutting blade provided in the cutting mechanism, holds the cut sheets at a circumferential surface of the folding cylinder by a sheet holding means provided in the folding cylinder, then, after rotating by an amount of a certain angle, thrusts out a middle portion of the held sheets from the circumferential surface of the folding cylinder toward between a folding roller pair located at positions facing one another or a jaw mechanism of a jaw cylinder by means of a folding blade provided in the folding cylinder, to fold these sheets at the middle portion. "Collect folding" refers to overlapping the sheets at the circumferential surface of the folding cylinder and then thrusting out the overlapped sheets by the folding blade to fold the sheets.

A folding device disclosed in Patent Document 1 comprises: a cutting cylinder including a cutting blade at two places in positions equally dividing an outer circumferential surface of the cutting cylinder in two; a folding cylinder which is provided such that its outer circumferential surface and the outer circumferential surface of the cutting cylinder are in close proximity with one another, has an outer circumferential dimension approximately 1.5 times that of the cutting cylinder, includes a cutting blade receiver at three places equally dividing the outer circumferential surface of the folding cylinder in three and capable of receiving a blade edge of the cutting blade, includes a paper holding pin projectable and retractable from the outer circumferential surface of the folding cylinder in close proximity to each of the cutting blade receivers, and, moreover, includes a folding blade projectable and retractable from the outer circumferential surface of the folding cylinder at three places approximately equally positioned between pin projecting/retracting positions in a circumferential direction of the outer circumferential surface; and a jaw cylinder which is provided such that its outer circumferential surface and the outer circumferential surface of the folding cylinder are in close proximity with one another, has an outer circumferential dimension approximately equal to that of the cutting cylinder, and includes a jaw mechanism at two places in positions equally dividing the outer circumferential surface of the jaw cylinder in two. In addition, a holding pin drive cam and a folding blade drive cam each provided with a concave portion displaced by 180 degrees on its circular outer circumferential surface are each provided at a position facing a side surface of the folding cylinder to be rotatable around an axial center of the folding cylinder with a rotational speed 1.5 times that of the folding cylinder, and, furthermore, a pin drive mask cam corresponding to the holding pin drive cam and provided with a concave portion at one place on its circular outer circumferential surface having the same diameter as the holding pin drive cam and a blade drive mask cam corresponding to the folding blade drive cam and provided with a concave portion at one place on its circular outer circumferential surface having the same diameter as the folding blade drive cam are each provided to be rotatable around the axial center of the folding cylinder with a rotational speed 1.5 times that of the folding cylinder, with the concave portion of the pin drive mask cam having a rotational phase identical to that of one of the concave portions of the holding pin drive cam in the case of the pin drive mask cam and with the concave portion of the blade drive mask cam having a rotational phase identical to that of one of the concave portions of the folding blade drive cam in the case of the blade drive mask cam, and are each provided such that moving in parallel to an axis direction of the folding cylinder enables displacement between a position preventing action of one of the concave portions of the corresponding drive cam and a position not preventing action of both of the concave portions of the corresponding drive cam. Moreover, the paper holding pin and the folding blade are each linked respectively to a pin support shaft or a blade support shaft parallel to a shaft of the folding cylinder, each of the support shafts has its end protruding from the side surface of the folding cylinder, and two cam followers are provided via arms to ends of each of the support shafts protruding from the side surface of the folding cylinder, one of the cam followers being provided to displace along the outer circumferential surface of the holding pin drive cam or the outer circumferential surface of the folding blade drive cam together with rotation of the folding cylinder, and the other of the cam followers being provided to displace along the outer circumferential surface of the pin drive mask cam or the outer circumferential surface of the blade drive mask cam that have displaced to the position disabling action of one of the concave portions of the drive cams together with rotation of the folding cylinder, and the two cam followers are provided such that, when one of the cam followers displaces following the concave portion of the drive cam, the support shaft undergoes angular displacement, the paper holding pin withdraws from the outer circumferential surface of the folding cylinder and the folding blade protrudes from the outer circumferential surface of the folding cylinder, and are provided such that withdrawal of the holding pin drive cam from the outer circumferential surface of the folding cylinder of the paper holding pin and protrusion of the folding blade drive cam from the outer circumferential surface of the folding cylinder of the folding blade are performed in an integrated manner.

Activating this folding device in a state where the pin drive mask cam and the blade drive mask cam have been displaced respectively to the position preventing action of one of the concave portions of the corresponding drive cam enables this folding device to perform "collect folding" which overlaps two sheets at the circumferential surface of the folding cylinder and then thrusts out the overlapped sheets by means of the folding blade to fold the sheets; activating this folding device in a state where the pin drive mask cam and the blade drive mask cam have been displaced respectively to the position not preventing action of both of the concave portions of the corresponding drive cams enables this folding device to perform "straight folding" which thrusts out the sheets by means of the folding blade without overlapping the sheets to fold the sheets.

A folding device disclosed in Patent Document 2 comprises: a cutting cylinder including a cutting blade at two places in positions equally dividing an outer circumferential surface of the cutting cylinder in two; a folding cylinder which is provided such that its outer circumferential surface and the outer circumferential surface of the cutting cylinder are in close proximity with one another, has an outer circumferential dimension approximately 1.5 times that of the cutting cylinder, includes a cutting blade receiver at three places equally dividing the outer circumferential surface of the folding cylinder in three and capable of receiving a blade edge of the cutting blade, includes a paper holding pin projectable and retractable from the outer circumferential surface of the folding cylinder in close proximity to each of the cutting blade receivers, and, moreover, includes a folding blade projectable and retractable from the outer circumferential surface of the folding cylinder at three places approximately equally positioned between pin projecting/retracting positions in a circumferential direction of the outer circumferential surface; and a jaw cylinder which is provided such that its outer circumferential surface and the outer circumferential surface of the folding cylinder are in close proximity with one another, has an outer circumferential dimension approximately equal to that of the cutting cylinder, and includes a jaw mechanism at two places in positions equally dividing the outer circumferential surface of the jaw cylinder in two. Alternatively, the folding device comprises a folding roller pair in place of the jaw mechanism, the folding roller pair provided in close proximity to the outer circumferential surface of the folding cylinder. In addition, a holding pin drive cam and a folding blade drive cam each provided with a concave portion on its circular outer circumferential surface are each provided fixed to a frame rotatably supporting the folding cylinder, at intervals in an axis direction of the folding cylinder, at a position facing a side surface of the folding cylinder, and, furthermore, a masking cam driven to rotate around an axial center of the folding cylinder is provided between the holding pin drive cam and the folding blade drive cam. The masking cam includes two half cams provided in a symmetrical positional relationship to an axial center of the masking cam, and these two half cams are configured to be movable in a radial direction of the masking cam. Further, when the half cam moves to a position of increased radius, the outer circumferential surface of the half cam attains an identical diameter to the outer circumferential surface of the holding pin drive cam and the folding blade drive cam, thereby preventing action of the concave portion provided to the holding pin drive cam and the folding blade drive cam. Moreover, when the half cam moves to a position of reduced radius, the outer circumferential surface of the half cam attains a position closer to the axial center of the masking cam than a bottom of the concave portion provided to the outer circumferential surface of the holding pin drive cam and the folding blade drive cam, thereby not preventing action of the concave portion provided to the holding pin drive cam and the folding blade drive cam. Note that when the folding cylinder has a configuration in which the paper holding pin and the folding blade are each provided in three places as previously described, a drive rotational speed of the masking cam is 0.75 times the rotational speed of the folding cylinder. Moreover, the paper holding pin and the folding blade are each linked respectively to a pin support shaft or a blade support shaft parallel to a shaft of the folding cylinder, each of the support shafts has its end protruding from the side surface of the folding cylinder, and two cam followers are provided via arms to ends of each of the support shafts protruding from the side surface of the folding cylinder, one of the cam followers being provided to displace along the outer circumferential surface of the holding pin drive cam or the outer circumferential surface of the folding blade drive cam together with rotation of the folding cylinder, and the other of the cam followers being provided to displace along the outer circumferential surface of the pin drive mask cam or the outer circumferential surface of the blade drive mask cam that have displaced to the position disabling action of one of the concave portions of the drive cams together with rotation of the folding cylinder, and the two cam followers are provided such that, when one of the cam followers displaces following the concave portion of the drive cam, the support shaft undergoes angular displacement, the paper holding pin withdraws from the outer circumferential surface of the folding cylinder and the folding blade protrudes from the outer circumferential surface of the folding cylinder, and are provided such that withdrawal of the holding pin drive cam from the outer circumferential surface of the folding cylinder of the paper holding pin and protrusion of the folding blade drive cam from the outer circumferential surface of the folding cylinder of the folding blade are performed in an integrated manner.

Activating this folding device in a state where either of the half cams of the masking cam has been moved to the position of increased radius and displaced to the position preventing action of the concave portion of the corresponding drive cam enables this folding device to perform "collect folding" which overlaps two sheets at the circumferential surface of the folding cylinder and then thrusts out the overlapped sheets by means of the folding blade to fold the sheets; activating this folding device in a state where either of the half cams of the masking cam has been moved to the position of increased radius and displaced to the position not preventing action of both of the concave portions of the corresponding drive earns enables this folding device to perform "straight folding" which thrusts out the sheets by means of the folding blade without overlapping the sheets to fold the sheets.

[Patent Document 1] JP 2000-505768 W

[Patent Document 2] JP 2008-56493 A

SUMMARY OF THE INVENTION

Such a folding device capable of collect folding as represented by Patent Documents 1 and 2 can only overlap two sheets on the circumferential surface of the folding cylinder. Moreover, since there is a need to drive-rotate the holding pin drive cam and folding blade drive cam and the masking cam, or to drive-rotate the masking cam, and since there is a need to provide a drive transmission mechanism for that purpose in a narrow area between the folding cylinder and the frame rotatably supporting this folding cylinder, many components are required, which, combined also with complexity of assembly, leads to an increase in initial costs. Furthermore, in the conventional folding device, due to the fact that installation of the drive transmission mechanism causes a proportionate increase in the probability of faults occurring and due to the fact that the drive transmission mechanism is provided in a narrow area, maintenance and upkeep management are also troublesome, and accompanying running costs also increase correspondingly.

The present invention was made in view of the above problems of the conventional technology, and an object of the present invention is to provide a folding device capable of collect folding in which any desired number of sheets can be overlapped on an outer circumferential surface of a folding cylinder. That is, an object of the present invention is to provide a folding device configured to enable straight folding that, when there is one sheet on the outer circumferential surface of the folding cylinder, protrudes a folding blade from the outer circumferential surface of the folding cylinder and retracts a paper holding pin from the outer circumferential surface of the folding cylinder to pass the sheet to a jaw cylinder or folding roller pair and fold the sheet, and, moreover, to enable collect folding that, after a desired number of sheets has been overlapped on the outer circumferential surface of the folding cylinder, protrudes the folding blade from the outer circumferential surface of the folding cylinder and retracts the paper holding pin from the outer circumferential surface of the folding cylinder to pass the sheets to the jaw cylinder or folding roller pair and fold the sheets. Furthermore, an object of the present invention is to provide a folding device that comprises a simple mode switching mechanism of straight folding and collect folding, that has a low probability of faults occurring, and moreover reduces initial costs and running costs.

The present invention aims for accomplishing the above object by the configuration described in the claims. That is, a folding device according to the present invention is a folding device for cutting and folding a continuous paper, comprising: a cutting mechanism including a cutting blade; a folding cylinder including a folding blade mechanism and a paper edge holding mechanism; and a folding mechanism for receiving and folding at least one sheet released by the folding cylinder, the folding device being characterized by comprising: a folding blade mechanism operation control mechanism for operating the folding blade mechanism provided in the folding cylinder; and a paper edge holding mechanism operation control mechanism for operating the paper edge holding mechanism provided in the folding cylinder, the folding blade mechanism operation control mechanism and the paper edge holding mechanism operation control mechanism being provided capable of activation based on a predetermined activating signal.

Moreover, in the folding device according to the present invention, a detecting means for detecting a rotational phase of the folding cylinder may be provided, and the folding blade mechanism operation control mechanism and the paper edge holding mechanism operation control mechanism may be provided capable of activation based on satisfaction of "AND" between a detection value of the detecting means matching a predetermined rotational phase value of the folding cylinder, and the predetermined activating signal.

Furthermore, in the folding device according to the present invention, the folding blade mechanism operation control mechanism and the paper edge holding mechanism operation control mechanism may each comprise: a drive cam provided fixed between a frame that rotatably supports the folding cylinder and a side surface of the folding cylinder; a masking cam capable of angular displacement around an axial center of the folding cylinder; and a masking cam drive means for causing angular displacement of the masking cam around the axial center of the folding cylinder.

Still further, in the folding device according to the present invention, a configuration may be adopted where the folding blade mechanism operation control mechanism and the paper edge holding mechanism operation control mechanism each have a plurality of the masking cams provided, and each have the masking cam drive means provided such that each of the respective masking cams can be separately driven.

Yet further, in the folding device according to the present invention, the same number of masking cams may be provided in each of the folding blade mechanism operation control mechanism and the paper edge holding mechanism operation control mechanism as there are folding blade mechanisms and paper edge holding mechanisms provided in the folding cylinder.

The folding device according to the present invention is capable of collect folding in which any desired number of sheets can be overlapped on the outer circumferential surface of the folding cylinder. In addition, the probability of faults occurring in the mode switching mechanism of straight folding and collect folding can be reduced, thus enabling improvement in operating efficiency, and, moreover, also enabling initial costs and running costs to be reduced.

DETAILED DESCRIPTION OF THE INVENTION

Preferred embodiments for carrying out the present invention are described below with reference to the drawings. The following embodiments are not intended to limit the inventions set forth in the claims, and the combinations of features described in the embodiments are not all necessarily indispensable for the means for solving the problem provided by the invention.

Figure 1:
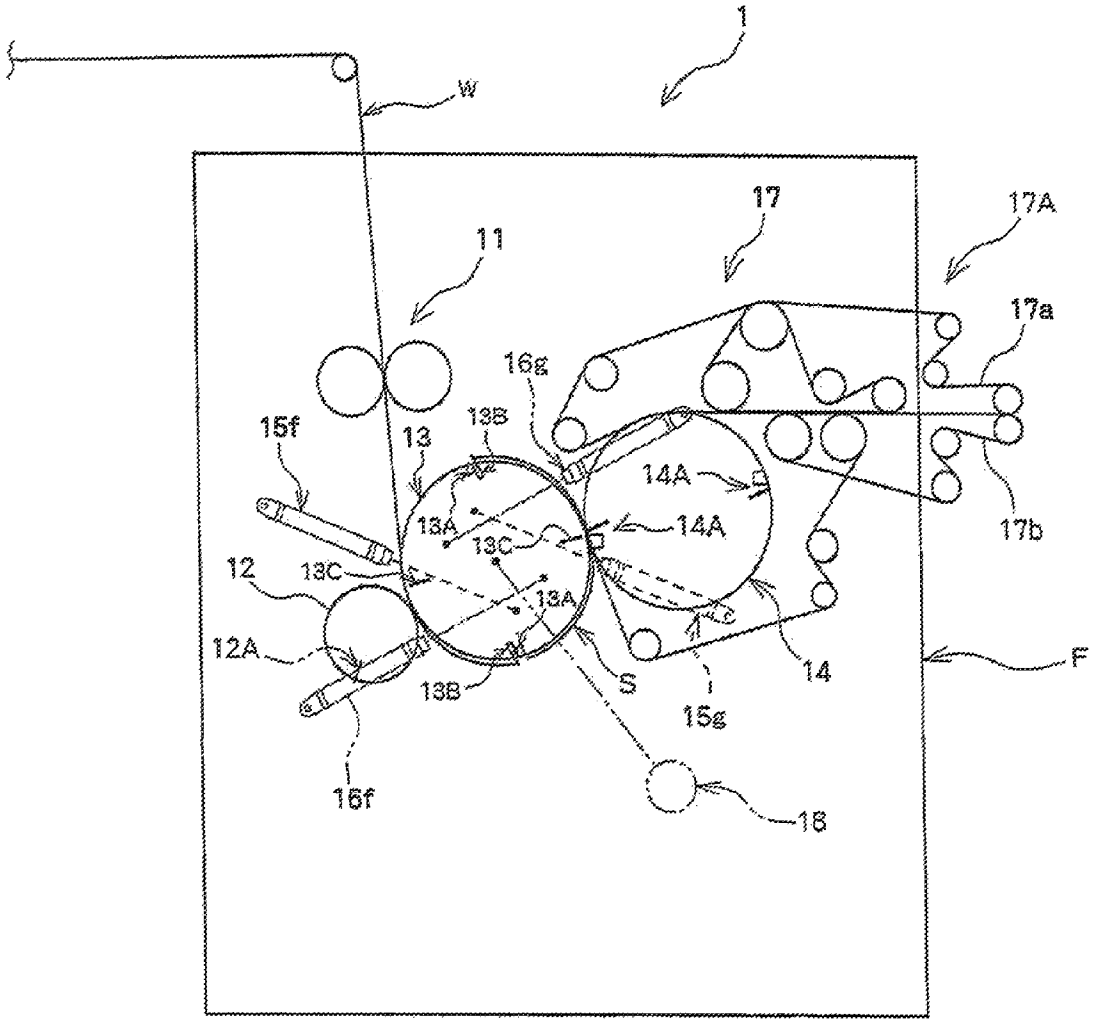
FIG. 1 is an elevation view skeleton diagram showing an overall configuration of a folding device according to a present embodiment.
Figure 2:
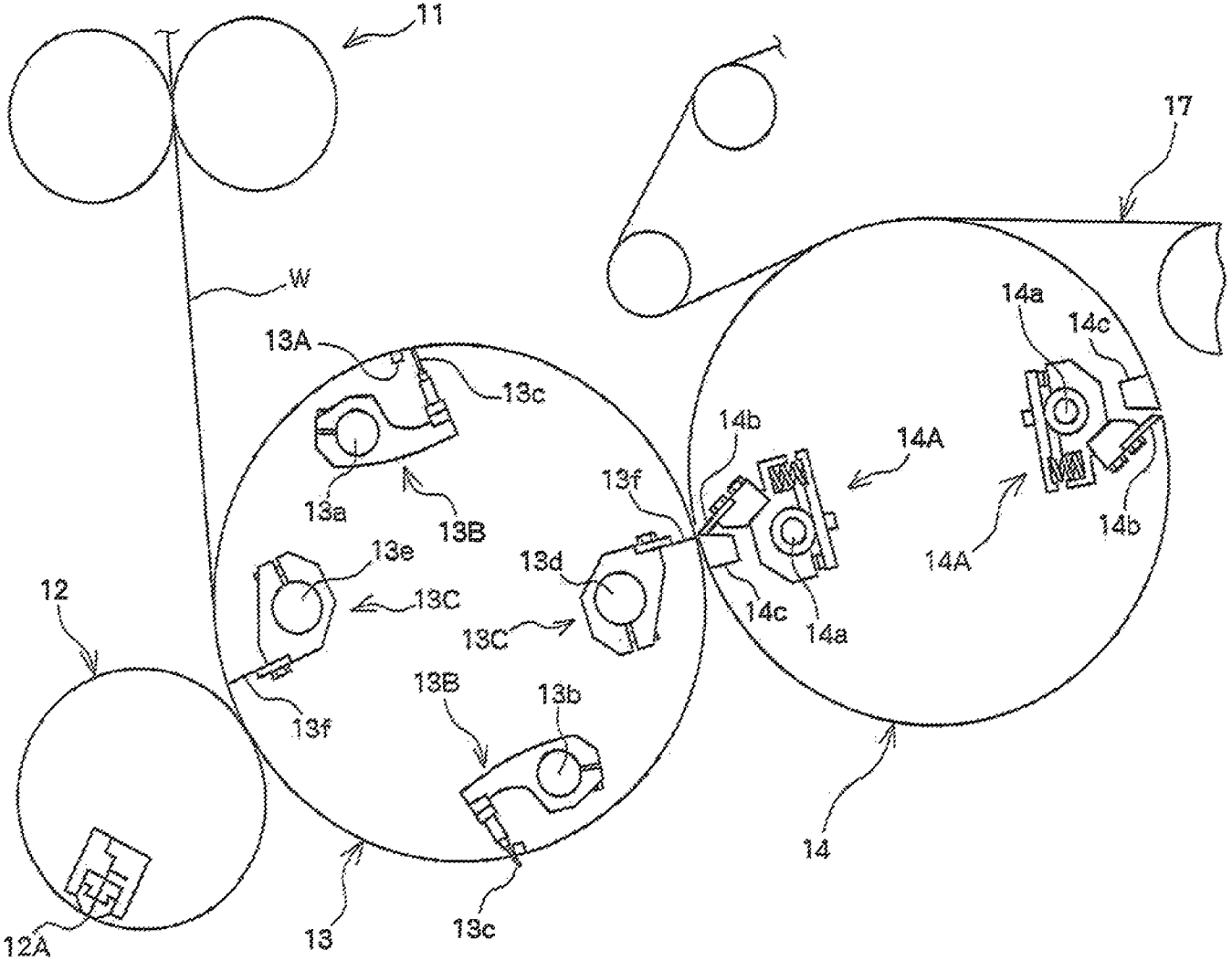
FIG. 2 is an elevation view skeleton diagram showing main parts of a cutting cylinder, a folding cylinder, and a jaw cylinder in the folding device shown in FIG. 1.
Figure 3:
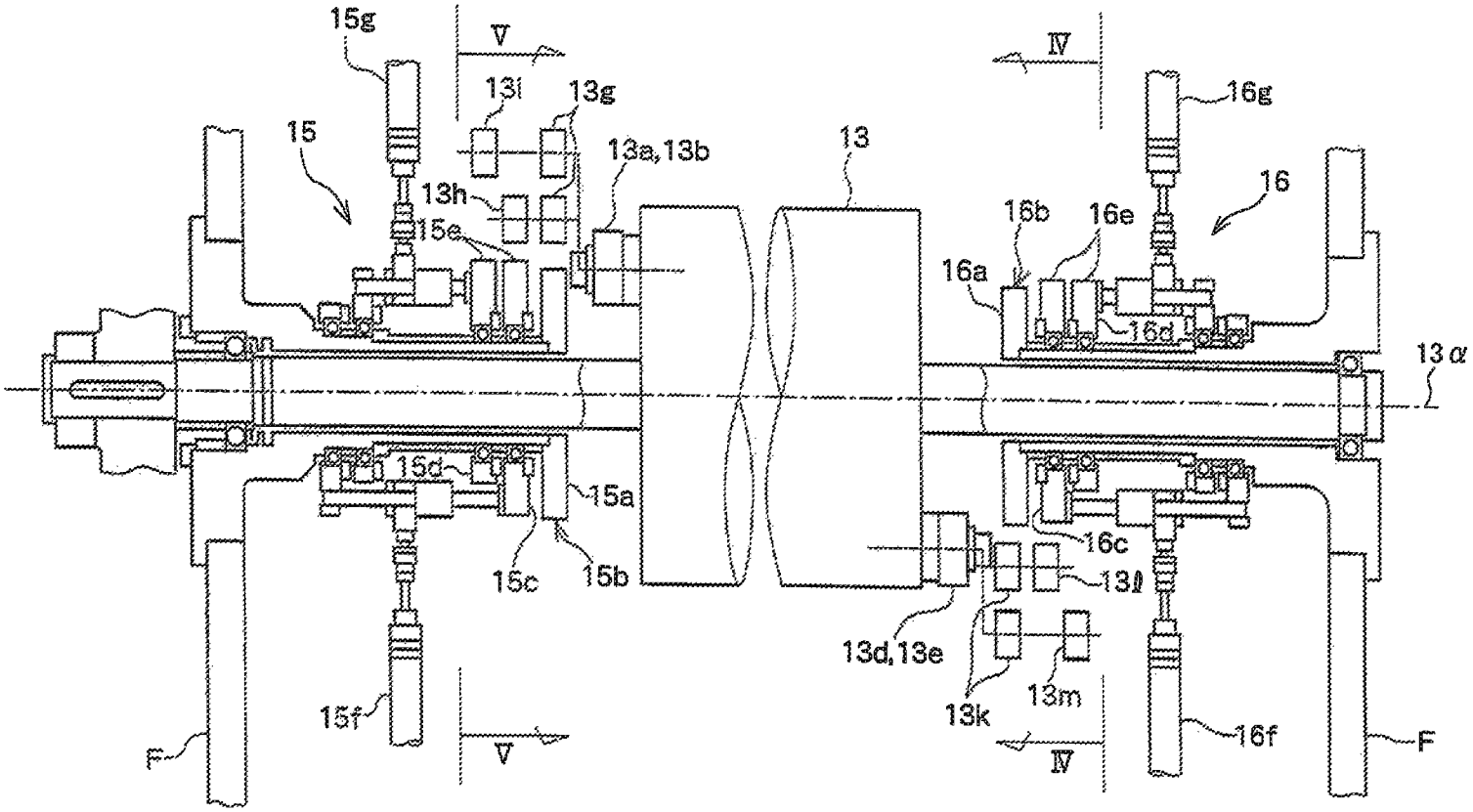
FIG. 3 is a partial cross-sectional parallel view along an axial center of the folding cylinder.
Figure 4:
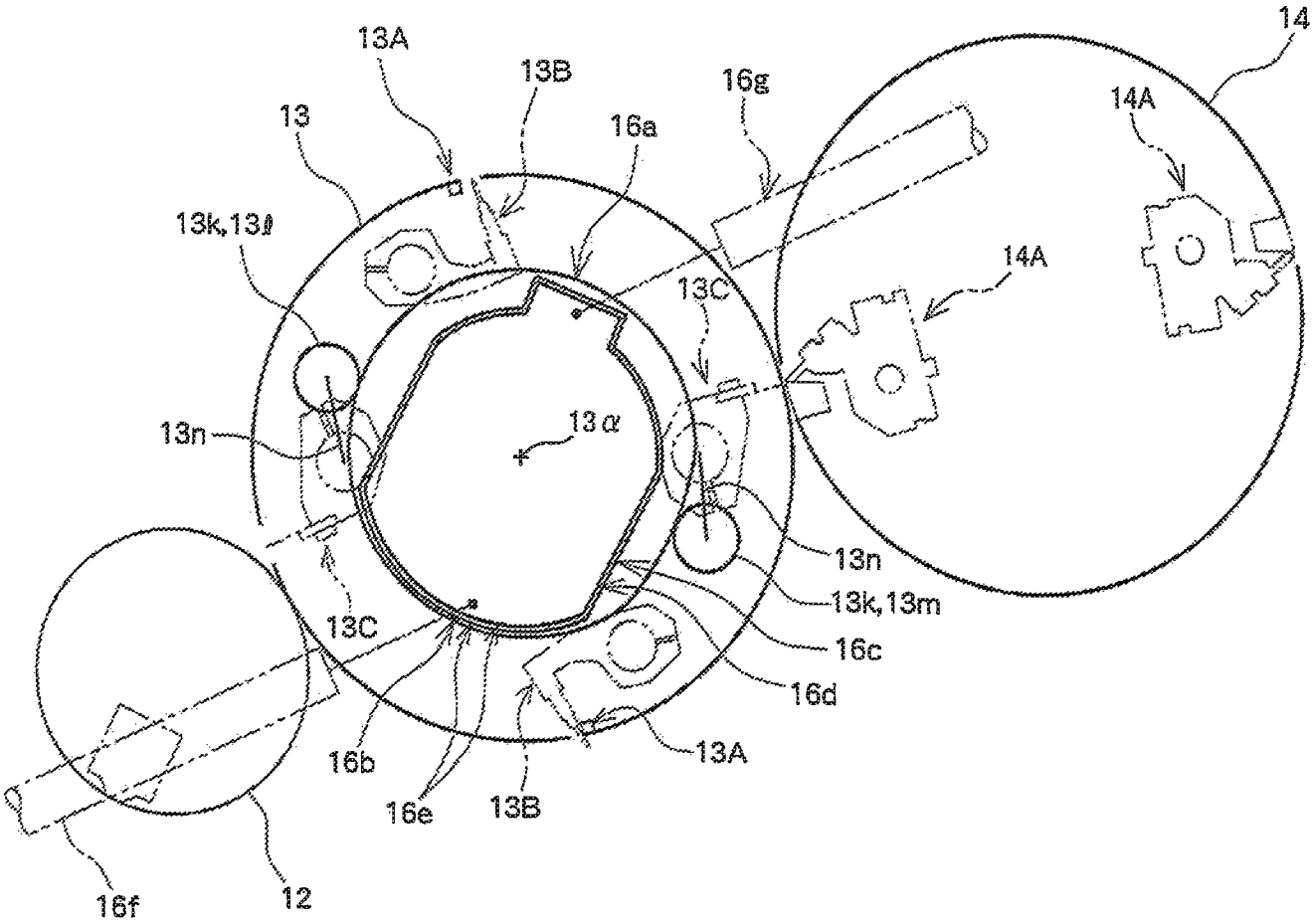
FIG. 4 is a view taken along the line IV-IV of FIG. 3 and viewed in the direction of the arrows, showing in particular a configuration of a cam and a cam follower in a folding blade mechanism operation control mechanism.
Figure 5:
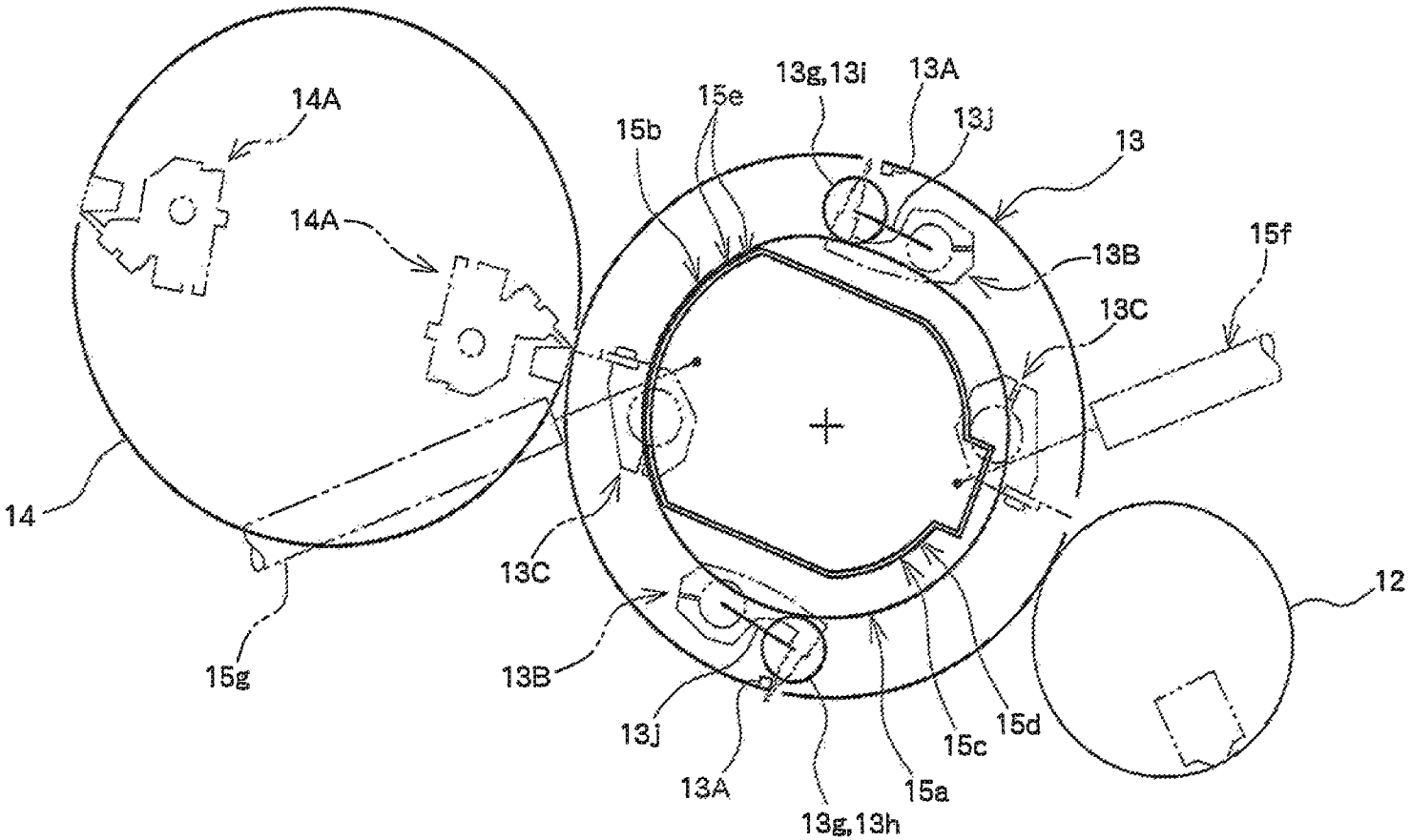
FIG. 5 is a view taken along the line V-V of FIG. 3 and viewed in the direction of the arrows, showing in particular a configuration of a cam and a cam follower in a paper edge holding mechanism operation control mechanism.
Figure 6:
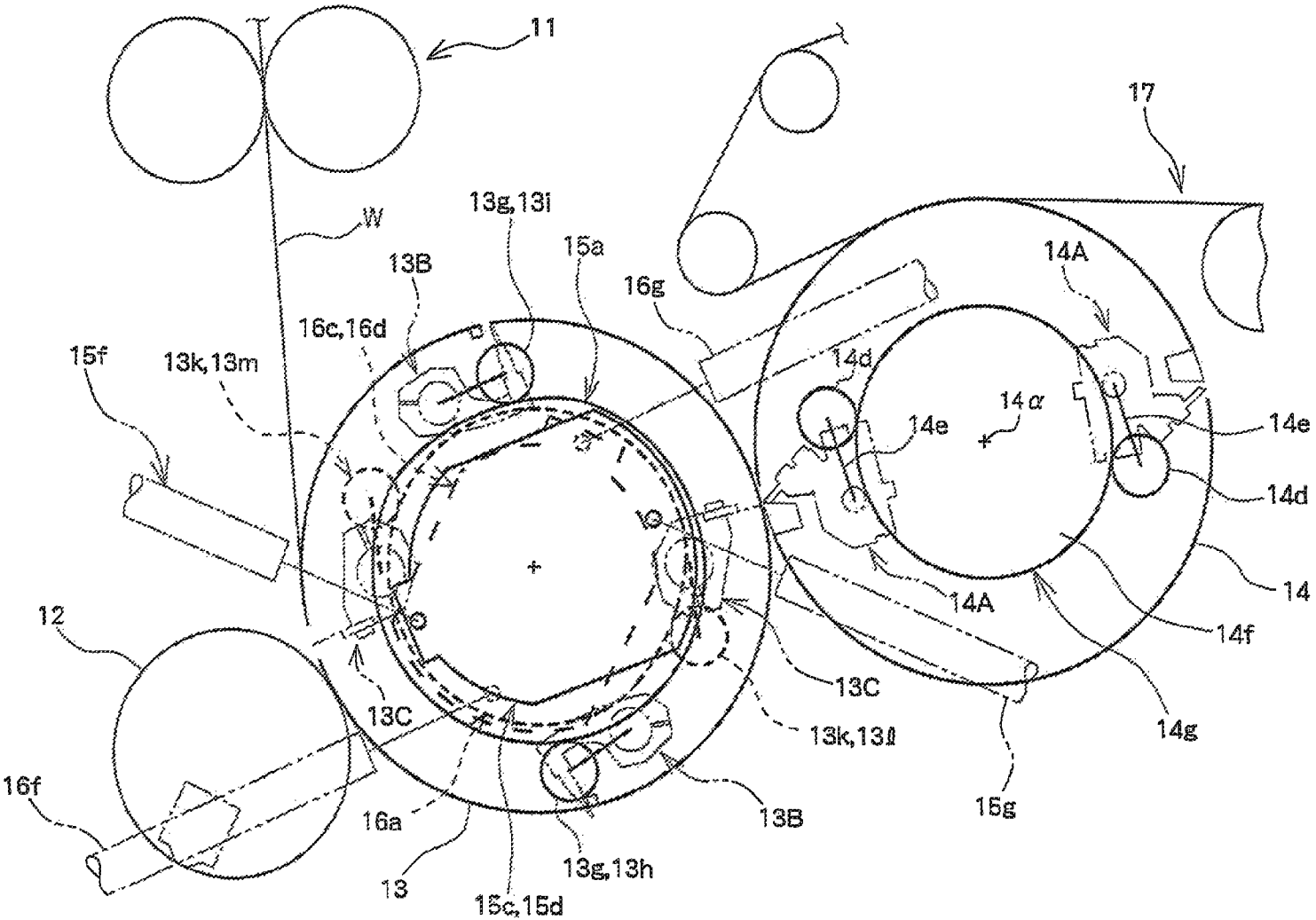
FIG. 6 is an elevation view skeleton diagram showing jointly the configuration of the cam and the cam follower in the folding blade mechanism operation control mechanism and the configuration of the cam and the cam follower in the paper edge holding mechanism operation control mechanism, and also showing jointly a configuration of a cam and a cam follower controlling operation of a jaw mechanism in the jaw cylinder.

FIG. 1 is an elevation view skeleton diagram showing an overall configuration of a folding device according to a present embodiment. FIG. 2 is an elevation view skeleton diagram showing main parts of a cutting cylinder, a folding cylinder, and a jaw cylinder in the folding device shown in FIG. 1. FIG. 3 is a partial cross-sectional parallel view along an axial center of the folding cylinder. FIG. 4 is a view taken along the line IV-IV of FIG. 3 and viewed in the direction of the arrows, showing in particular a configuration of a cam and a cam follower in a folding blade mechanism operation control mechanism. FIG. 5 is a view taken along the line V-V of FIG. 3 and viewed in the direction of the arrows, showing in particular a configuration of a cam and a cam follower in a paper edge holding mechanism operation control mechanism. FIG. 6 is an elevation view skeleton diagram showing jointly the configuration of the cam and the cam follower in the folding blade mechanism operation control mechanism and the configuration of the cam and the cam follower in the paper edge holding mechanism operation control mechanism, and also showing jointly a configuration of a cam and a cam follower controlling operation of a jaw mechanism in the jaw cylinder.

A folding device 1 comprises a drag roller mechanism 11 that draws a continuous paper W into the folding device 1. The folding device 1 comprises, on a downstream side of the drag roller mechanism 11, a cutting cylinder 12, a folding cylinder 13, and a jaw cylinder 14 which are disposed in a state of having their outer circumferential surfaces in close proximity to one another and which are each driven to rotate around a respective axial center that is perpendicular to a running direction of the continuous paper W and parallel to a surface of the running continuous paper W. The folding device 1 comprises, on a downstream side of the jaw cylinder 14, a delivery mechanism 17 that delivers to a downstream side a signature (not illustrated) formed by the jaw cylinder 14. In addition, the folding device 1 comprises a detecting means 18 enabling detection of a rotational phase of the folding cylinder 13.

The cutting cylinder 12 comprises a cutting blade 12A at its outer circumferential surface. In the embodiment shown in the drawings, an outer circumferential dimension of the cutting cylinder 12 is substantially equal to a length that the continuous paper W is cut.

The folding cylinder 13 has an outer circumferential dimension which is approximately twice that of the cutting cylinder 12, and comprises, at two places bisecting its outer circumferential surface, a cutting blade receiver 13A capable of receiving a blade edge of the cutting blade 12A. Moreover, the folding cylinder 13 comprises a paper edge holding mechanism 13B in a vicinity of each cutting blade receiver 13A. In addition, the folding cylinder 13 comprises two folding blade mechanisms 13C at substantially equally divided positions between disposal positions of the paper edge holding mechanisms 13B in the circumferential direction of the folding cylinder 13.

Furthermore, regarding the folding cylinder 13, a paper edge holding mechanism operation control mechanism 15 for operating the paper edge holding mechanism 13B and a folding blade mechanism operation control mechanism 16 for operating the folding blade mechanism 13C are provided between the folding cylinder 13 and a frame that rotatably supports this folding cylinder 13.

The paper edge holding mechanism 13B includes, on pin support shafts 13*a* and 13*b* provided to the folding cylinder 13 so as to be parallel to an axis direction of the folding cylinder 13, a plurality of paper holding pins 13*c* attached at appropriate intervals in a direction parallel to a paper surface in FIG. 2, and is provided such that, in accordance with a reciprocating angular displacement of the pin support shafts 13*a* and 13*b*, a point of the paper holding pin 13*c* is projectable and retractable from an outer circumferential surface on an upstream side of a vicinity of the cutting blade receiver 13A in the outer circumferential surface of the folding cylinder 13 in the rotational direction of the folding cylinder 13. The folding blade mechanism 13C includes a folding blade 13*f* attached to blade support shafts 13*d* and 13*e* provided to the folding cylinder 13 so as to be parallel to the axis direction of the folding cylinder 13, and is provided such that, in accordance with a reciprocating angular displacement of the blade support shafts 13*d* and 13*e*, a point of the folding blade 13*f* is projectable and retractable at substantially equally divided positions between retraction sites of points of the paper holding pins 13*c* in the outer circumferential surface of the folding cylinder 13.

At least one end of each of the pin support shafts 13*a* and 13*b* of the paper edge holding mechanism 13B projects outwardly from one side surface of the folding cylinder 13, and to this one end, two arms 13*j* and 13*j* having cam followers 13*g*, 13*h*, or 13*i* rotatably attached to a free end side thereof each have a base end side fixed with an identical phase with respect to the pin support shafts 13*a* or 13*b* at appropriate intervals in the axis direction (direction parallel to a paper surface in FIG. 5). Further, in the paper edge holding mechanism 13B, a circumferential surface of the cam follower 13*g* is provided to be constantly in contact with an endless cam surface 15*b* of a later-to-be-described paper holding pin drive cam 15*a* and to be displacable in accordance with its irregularities, in accordance with rotation of the folding cylinder 13, a circumferential surface of the cam follower 13*h* is provided to be in contact with a mask cam surface 15*e* of a later-to-be-described masking cam 15*c* and to be displacable in accordance therewith, in accordance with rotation of the folding cylinder 13, and a circumferential surface of the cam follower 13*i* is provided to be in contact with a mask cam surface 15*e* of a later-to-be-described masking cam 15*d* and to be displacable in accordance therewith, in accordance with rotation of the folding cylinder 13. Moreover, at least another end of each of the blade support shafts 13*d* and 13*e* of the folding blade mechanism 13C projects outwardly from the other side surface of the folding cylinder 13 which is an opposite side to the one side surface of the folding cylinder 13 from which the pin support shafts 13*a* and 13*b* of the paper edge holding mechanism 13B project, and to this other end, two arms 13*n* and 13*n* having cam follower 13*k*, 13*l*, or 13*m* rotatably attached to a free end side thereof each have a base end side fixed with an identical phase with respect to the blade support shafts 13*d* or 13*e* at appropriate intervals in the axis direction (direction perpendicular to a paper surface in FIG. 4). Further, in the folding blade mechanism 13C, a circumferential surface of the cam follower 13*k* is provided to be constantly in contact with an endless cam surface 16*b* of a later-to-be-described folding blade drive cam 16*a* and to be displacable in accordance with its irregularities, in accordance with rotation of the folding cylinder 13, a circumferential surface of the cam follower 13*l* is provided to be in contact with a mask cam surface 16*e* of a masking cam 16*c* and to be displacable in accordance therewith, in accordance with rotation of the folding cylinder 13, and a circumferential surface of the cam follower 13*m* is provided to be in contact with a mask cam surface 16*e* of a masking cam 16*d* and to be displacable in accordance therewith, in accordance with rotation of the folding cylinder 13.

Meanwhile, the paper edge holding mechanism operation control mechanism 15 for operating the paper edge holding mechanism 13B is provided between the folding cylinder 13 and the frame F that faces the one side surface of the folding cylinder 13. That is, the paper holding pin drive cam 15*a* is provided fixed to the frame F via a shaft bearing sleeve of the folding cylinder 13. The paper holding pin drive cam 15*a* includes the endless cam surface 15*b* in which a distance from an axial center 13α of the folding cylinder 13 at which the paper holding pin 13*c* is to be operated changes in a predetermined state, and this endless cam surface 15*b* is provided disposed at a position to be rotatable and contacted by the outer circumferential surface of the cam follower 13*g* attached to the free end side of one of the arms 13*j* fixed to the one end of the pin support shafts 13*a* and 13*b*. Furthermore, the masking cams 15*c* and 15*d* are provided at a position adjacent to the paper holding pin drive cam 15*a*. The masking cams 15*c* and 15*d* each include at least the mask cam surface 15*e* that invalidates an area (small diameter area) for retracting the paper holding pin 13*c* from the outer circumferential surface of the folding cylinder 13 in the endless cam surface 15*b* of the paper holding pin drive cam 15*a*. Moreover, this mask cam surface 15*e* is capable of displacement between a state invalidating the small diameter area in the endless cam surface 15*b* of the paper holding pin drive cam 15*a* and a state not invalidating the small diameter area, and, when the mask cam surface 15*e* of the masking cams 15*c* and 15*d* is in a state of at least invalidating the small diameter area in the endless cam surface 15*b* of the paper holding pin drive cam 15*a*, this mask cam surface 15*e* is provided disposed at a position to be rotatable and contacted by the outer circumferential surface of the cam followers 13*h* or 13*i* attached to the free end side of the other of the arms 13*j* fixed to the one end of the pin support shafts 13*a* and 13*b*. Note that a masking cam drive means for displacing the masking cams 15*c* and 15*d* may be, for example, hydraulic actuated cylinders 15*f* and 15*g* attached to the frame F, and is provided capable of activation by an appropriately outputted activating signal, for example, a predetermined activating signal outputted from an appropriate signal output means or by satisfaction of "AND" between this activating signal and a detection signal outputted based on a detection value of a detecting means 18 for detecting a rotational phase of the folding cylinder 13. As shown in FIG. 1, when an output rod of the hydraulic actuated cylinders 15*f* and 15*g* extends, the masking cams 15*c* and 15*d* each undergoes angular displacement around the axial center 13α of the folding cylinder 13, and the mask cam surface 15*e* moves to a position overlapping the small diameter area in the endless cam surface 15*b* of the paper holding pin drive cam 15*a*. As shown in FIGS. 5 and 6, when the output rod of the hydraulic actuated cylinders 15*f* and 15*g* retracts, the masking cams 15*c* and 15*d* each undergoes angular displacement around the axial center 13α of the folding cylinder 13, and the mask cam surface 15*e* moves to a position not overlapping the small diameter area in the endless cam surface 15*b* of the paper holding pin drive cam 15*a*. In other words, extension and retraction of the output rod of the hydraulic actuated cylinders 15*f* and 15*g* causes the masking cams 15*c* and 15*d* to undergo back-and-forth angular displacement around the axial center 13α of the folding cylinder 13 and undergo displacement between a state invalidating the small diameter area in the endless cam surface 15*b* of the paper holding pin drive cam 15*a* and a state not invalidating the small diameter area.

Note that, in FIGS. 5 and 6, in order to facilitate understanding of the paper holding pin drive cam 15*a* and the masking cams 15*c* and 15*d*, a distance from the axial center 13α of the folding cylinder 13 of an area (large diameter area) for projecting the paper holding pin 13*c* from the outer circumferential surface of the folding cylinder 13 in the endless cam surface 15*b* of the paper holding pin drive cam 15*a*, and a distance from the axial center 13α of the folding cylinder 13 of the mask cam surface 15*e* of the masking cams 15*c* and 15*d* are, for convenience, shown to differ. However, in reality, both distances are provided to be equal. Similarly, for convenience, sizes of the two masking cams 15*c* and 15*d* are shown to differ, but, in reality, are the same. Moreover, an appropriate stopper (not illustrated) for limiting an amount of angular displacement of the masking cams 15*c* and 15*d* may of course be provided.

At the same time, the folding blade mechanism operation control mechanism 16 for operating the folding blade mechanism 13C is provided between the folding cylinder 13 and the frame F that faces the other side surface of the folding cylinder 13. That is, the folding blade drive cam 16*a* is provided fixed to the frame via a shaft bearing sleeve of the folding cylinder 13. The folding blade drive cam 16*a* includes the endless cam surface 16*b* in which a distance from the axial center 13α of the folding cylinder 13 at which the folding blade 13*f* is to be operated changes in a predetermined state, and this endless cam surface 16*b* is provided disposed at a position to be rotatable and contacted by the outer circumferential surface of the cam follower 13*k* attached to the free end side of one of the arms 13*m* fixed to the other end of the blade support shafts 13*d* and 13*e*. Furthermore, the masking cams 16*c* and 16*d* are provided at a position adjacent to the folding blade drive cam 16*a*. The masking cams 16*c* and 16*d* each include at least the mask cam surface 16*e* that invalidates an area (small diameter area) for projecting the folding blade 13*f* from the outer circumferential surface of the folding cylinder 13 in the endless cam surface 16*b* of the folding blade drive cam 16*a*. Moreover, this mask cam surface 16*e* is capable of displacement between a state invalidating the small diameter area in the endless cam surface 16*b* of the folding blade drive cam 16*a* and a state not invalidating the small diameter area, and, when the mask cam surface 16*e* of the masking cams 16*c* and 16*d* is in a state of at least invalidating the small diameter area in the endless cam surface 16*b* of the folding blade drive cam 16*a*, this mask cam surface 16*e* is provided disposed at a position to be rotatable and contacted by the outer circumferential surface of the cam followers 13*l* or 13*m* attached to the free end side of the other of the arms 13*n* fixed to the other end of the blade support shafts 13*d* or 13*e*. Note that a masking cam drive means for displacing the masking cams 16*c* and 16*d* may be, for example, hydraulic actuated cylinders 16*f* and 16*g* attached to the frame F, and is provided capable of activation by an appropriately outputted activating signal, for example, a predetermined activating signal outputted from an appropriate signal output means or by satisfaction of "AND" between this activating signal and a detection signal outputted based on a detection value of the detecting means 18 for detecting the rotational phase of the folding cylinder 13. As shown in FIG. 1, when an output rod of the hydraulic actuated cylinders 16*f* and 16*g* extends, the masking cams 16*c* and 16*d* each undergoes angular displacement around the axial center 13α of the folding cylinder 13, and the mask cam surface 16*e* moves to a position overlapping the small diameter area in the endless cam surface 16*b* of the folding blade drive cam 16*a*. As shown in FIGS. 5 and 6, when the output rod of the hydraulic actuated cylinders 16*f* and 16*g* retracts, the masking cams 16*c* and 16*d* each undergoes angular displacement around the axial center 13α of the folding cylinder 13, and the mask cam surface 16*e* moves to a position not overlapping the small diameter area in the endless cam surface 16*b* of the folding blade drive cam 16*a*. In other words, extension and retraction of the output rod of the hydraulic actuated cylinders 16*f* and 16*g* causes the masking cams 16*c* and 16*d* to undergo back-and-forth angular displacement around the axial center 13α of the folding cylinder 13 and undergo displacement between a state invalidating the small diameter area in the endless cam surface 16*b* of the folding blade drive cam 16*a* and a state not invalidating the small diameter area.

Note that, in FIGS. 4 and 6, in order to facilitate understanding of the folding blade drive cam 16*a* and the masking cams 16*c* and 16*d*, a distance from the shaft center 13α of the folding cylinder 13 of an area (large diameter area) for retracting the folding blade 13*f* from the outer circumferential surface of the folding cylinder 13 in the endless cam surface 16*b* of the folding blade drive cam 16*a*, and a distance from the axial center 13α of the folding cylinder 13 of the mask cam surface 16*e* of the masking cams 16*e* and 16*d* are, for convenience, shown to differ. However, in reality, both distances are provided to be equal. Similarly, for convenience, sizes of the two masking cams 16*c* and 16*d* are shown to differ, but, in reality, are the same. Moreover, an appropriate stopper (not illustrated) for controlling an amount of angular displacement of the masking cams 16*c* and 16*d* may of course be provided.

The jaw cylinder 14 has an outer circumferential dimension which is substantially the same as that of the folding cylinder 13, and comprises, at two places bisecting its outer circumferential surface, a jaw mechanism 14A.

The jaw mechanism 14A includes a plate member 14*b* attached to a plate support shaft 14*a* provided to the jaw cylinder 14 so as to be parallel to an axis direction of the jaw cylinder 14, and is provided so as to be adjacency-or-contact-capable and separation-capable with respect to a block member 14*c* provided fixed to the jaw cylinder 14 facing the plate member 14*b*, in accordance with a back-and-forth angular displacement of the plate support shaft 14*a*. Moreover, as a result of the plate member 14*b* being adjacent to or contacting the block member 14*c*, a middle part in a cutting length direction of a single sheet S or plurality of sheets S formed by cutting the continuous paper W and caused to protrude from the outer circumferential surface of the folding cylinder 13 by the folding blade 13*f* of the folding cylinder 13 is sandwiched and received, and the paper sheets S are folded in two at their middle part to form a signature. In the embodiment shown in the drawings, the jaw cylinder 14 is capable of receiving from the folding cylinder 13 two in succession of the single sheet S or plurality of sheets S of identical configuration formed b cutting the continuous paper W, and the jaw cylinder 14 that has received two in succession of the sheets S of identical configuration is able to release two signatures of identical configuration toward the later-to-be-described delivery mechanism 17, while making one revolution after receiving the sheets S.

At least one end of the plate support shaft 14*a* of the jaw mechanism 14A projects outwardly from one side surface of the jaw cylinder 14, and to this one end, an arm 14*e* having a cam follower 14*d* rotatably attached to a free end side thereof has a base end side fixed. Further, in the jaw mechanism 14A, a circumferential surface of the cam follower 14*d* is provided to be constantly in contact with an endless cam surface 14*g* of a later-to-be-described plate member drive cam 14*f* and to be displacable in accordance with its irregularities, in accordance with rotation of the jaw cylinder 14.

Meanwhile, the plate member drive cam 14*f* is provided fixed to the frame F that rotatably supports the jaw cylinder 14, at a position facing the one side surface of the jaw cylinder 14, via a shaft bearing sleeve of the jaw cylinder 14, similarly to the paper holding pin drive cam 15*a* or the folding blade drive cam 16*a*, for example. The plate member drive cam 14*f* includes the endless cam surface 14*g* in which a distance from an axial center 14α of the jaw cylinder 14 at which the plate member 14*b* is to be operated changes in a predetermined state, and this endless cam surface 14*g* is provided disposed at a position to be rotatable and contacted by the outer circumferential surface of the cam follower 14*d* attached to the free end side of the arm 14*e* fixed to the one end of the plate support shaft 14*a*.

Note that the plate member 14*b* need only have a width in the axis direction of the jaw cylinder 14 that is at least slightly less than a width dimension of the sheet S gripped by the jaw mechanism 14A, may be provided divided or in an integrated manner, and, is normally provided having at least a leading edge side appropriately divided.

The delivery mechanism 17 comprises a delivery conveyor 17A. The delivery conveyor 17A includes an upper conveyor 17*a* and a lower conveyor 17*b* having carrying surfaces that face each other and are displaced in the same direction, and carries a signature released by the jaw mechanism 14A of the jaw cylinder 14 sandwiched between the upper conveyor 17*a* and the lower conveyor 17*b*, to send forth the signature to the downstream side.

The detecting means 18 is, for example, an absolute encoder having an origin, that is capable of detecting the rotational phase of the folding cylinder 13, and is provided linked to the axis of the folding cylinder 13 or to a member that rotates with a certain ratio with respect to this axis of the folding cylinder 13.

Next, operation of the folding device 1 according to the present embodiment configured as described above is described.

First, operation of collect folding is described.

Prior to operation start, the output rod of the hydraulic actuated cylinders 15*f* and 15*g*, and 16*f* and 16*g* is each set to an extended state, in other words, to a state where the masking cams 15*c* and 15*d* mask the concave portion of the endless cam surface 15*b* of the paper holding pin drive cam 15*a* to invalidate action of this concave portion, and the masking cams 16*c* and 16*d* mask the concave portion of the endless cam surface 16*b* of the folding blade drive cam 16*a* to invalidate action of this concave portion.

Next, the folding device 1 is started up.

In the folding device 1, the cutting blade 12A of the cutting cylinder 12 and the cutting blade receiver 13A of the folding cylinder 13 engage at a facing position of the cutting cylinder 12 and the folding cylinder 13, and the cutting cylinder 12, the folding cylinder 13, and the jaw cylinder 14 rotate with an almost identical circumferential surface speed with a mutual rotational phase that enables delivery of the sheet S at the facing position of the folding cylinder 13 and the jaw cylinder 14 due to the folding blade mechanism 13C of the folding cylinder 13 and the jaw mechanism 14A of the jaw cylinder 14.

The continuous paper W that has been guided to the folding device 1 from an upstream side is pulled in by the drag roller mechanism 11 and sent to between the cutting cylinder 12 and the folding cylinder 13.

The continuous paper W sent to between the cutting cylinder 12 and the folding cylinder 13 is first held by the paper holding pin 13*c* due to a point side of the paper holding pin 13*c* projecting from a circumferential surface of the folding cylinder 13 piercing the continuous paper W and cut by engagement of the cutting blade 12A and the cutting blade receiver 13A at an adjacent downstream position to that held position. Then, every half revolution of the folding cylinder 13, this holding of the continuous paper W due to the paper holding pin 13*c* and cutting of the continuous paper W due to engagement of the cutting blade 12A and the cutting blade receiver 13A are performed, and, every half circumferential surface of the folding cylinder 13, the sheet S is held and overlapped.

During this overlapping of the sheet 5, the mask cam surface 15*e* of the masking cams 15*c* and 15*d* overlaps the small diameter area of the endless cam surface 15*b* of the paper holding pin drive cam 15*a*, and continues to invalidate action of the small diameter area of the endless cam surface 15*b*, and the point side of the paper holding pin 13*c* does not retract from the outer circumferential surface of the folding cylinder 13. Similarly, the mask cam surface 16*e* of the masking cams 16*c* and 16*d* overlaps the small diameter area of the endless cam surface 16*b* of the folding blade drive cam 16*a*, and continues to invalidate action of the small diameter area of the endless cam surface 16*b*, and the point side of the folding blade 13*f* does not project from the outer circumferential surface of the folding cylinder 13.

When an overlap number of the sheet S reaches a desired number, the folding cylinder 13 delivers the sheets S overlapped on its outer circumferential surface to the jaw mechanism 14A of the jaw cylinder 14. That is, when the overlap number of the sheet S reaches the desired number, a predetermined activating signal is outputted from an appropriate signal output means that detects the overlap number of the sheet S by a detecting means such as a count sensor, for example, or, in a state where this activating signal is outputted, WAND" is established between this activating signal and a detection signal based on a detection value of the detecting means 18 for detecting the rotational phase of the folding cylinder 13, whereby the output rod of the hydraulic actuated cylinders 15*f* and 15*g* and the hydraulic actuated cylinders 16*f* and 16*g* retracts. Retraction of the output rod of the hydraulic actuated cylinders 15*f* and 15*g* causes the masking cams 15*c* and 15*d* to undergo angular displacement in an anticlockwise direction in FIG. 5 around the axial center 13α of the folding cylinder 13, and the mask cam surface 15*e* to deviate from the small diameter area of the endless cam surface 15*b* of the paper holding pin drive cam 15*a*, thereby validating action of this small diameter area. Similarly, retraction of the output rod of the hydraulic actuated cylinders 16*f* and 16*g* causes the masking cams 16*c* and 16*d* to undergo angular displacement in a clockwise direction in FIG. 4 around the axial center 13α of the folding cylinder 13, and the mask cam surface 16*e* to deviate from the small diameter area of the endless cam surface 16*b* of the folding blade drive cam 16*a*, thereby validating action of this small diameter area.

When action of the small diameter area of the endless cam surface 15*b* of the paper holding pin drive cam 15*a* is validated, the outer circumferential surface of the cam follower 13*g* attached to the free end side of one of the arms 13*j* fixed to one end of the pin support shafts 13*a* and 13*b* contacts this endless cam surface 15*b* to rotate, displaces the arm 13*j* according to a change in distance of the endless cam surface 15*b* from the axial center 13α of the folding cylinder 13 and causes the pin support shafts 13*a* and 13*b* to each undergo angular displacement via the arm 13*j*, and, when the cam follower 13*g* passes the small diameter area of the endless cam surface 15*b*, the paper holding pin 13*c* retracts inside from the outer circumferential surface of the folding cylinder 13. When the paper holding pin 13*c* retracts inside from the outer circumferential surface of the folding cylinder 13, the sheet S that was held in the outer circumferential surface of the folding cylinder 13 by the paper holding pin 13*c* is released.

Moreover, when action of the small diameter area of the endless cam surface 16*b* of the folding blade drive cam 16*a* is validated, the outer circumferential surface of the cam follower 13*k* attached to the free end side of one of the arms 13*n* fixed to one end of the blade support shafts 13*d* and 13*e* contacts this endless cam surface 16*n* to rotate, displaces the arm 13*n* according to a change in distance of the endless cam surface 16*b* from the axial center 13α of the folding cylinder 13 and causes the blade support shafts 13*d* and 13*e* to each undergo angular displacement via the arm 13*n*, and, when the cam follower 13*k* passes the small diameter area of the endless cam surface 16*b*, the leading edge side of the folding blade 13*f* projects from the outer circumferential surface of the folding cylinder 13. When the leading edge side of the folding blade 13*f* projects from the outer circumferential surface of the folding cylinder 13, the sheet S that was held in the outer circumferential surface of the folding cylinder 13 by the paper holding pin 13*c* is projected out to separate in a radial direction from the outer circumferential surface of the folding cylinder 13.

The paper holding pin drive cam 15*a* and the folding blade drive cam 16*a* herein are provided such that release of the sheet S by the paper holding pin 13*c* due to action of the small diameter area of the endless cam surface 15*b* of the paper holding pin drive cam 15*a* and separation of the sheet S from the circumferential surface of the folding cylinder 13 by the folding blade 13*f* due to action of the small diameter area of the endless cam surface 16*b* of the folding blade drive cam 16*a* are performed in substantially the same rotational phase of the folding cylinder 13, and a projection position of the folding blade 13*f* of the folding cylinder 13 in this rotational phase is provided to face a position at which the plate member 14*b* and the block member 14*c* of the jaw mechanism 14A are adjacent or contacting in a rotational phase of the jaw cylinder 14 to be described later. Therefore, as a result of the leading edge side of the folding blade 13*f* protruding from the outer circumferential surface of the folding cylinder 13, the middle part in a cutting length direction of the sheet S released from the paper holding pin 13*c* is protruded toward the jaw mechanism 14A of the jaw cylinder 14, this middle part is sandwiched by the plate member 14*b* and the block member 14*c* to be received, gripped, and folded by the jaw mechanism 14A, thereby forming the signature which is the sheet S folded in two and having a fold line formed in its middle part parallel to the axis of the jaw cylinder 14.

The jaw cylinder 14 of the folding device 1 rotates while maintaining the previously mentioned relationships of rotation direction, rotation speed, and rotation phase with the folding cylinder 13, and in each revolution, the plate member 14*b* of the jaw mechanism 14A repeats adjacency-or-contact and separation of its leading edge side with respect to the block member 14*c* of the jaw mechanism 14A. That is, the outer circumferential surface of the cam follower 14*d* attached to the free end side of the arm 14*e* fixed to one end of the plate support shaft 14*a* to which the plate member 14*b* is attached contacts the endless cam surface 14*g* of the plate member drive cam 14*f* provided fixed to the frame F facing one side surface of the jaw cylinder 14 to rotate, displaces the arm 14*e* according to a change in distance of the endless cam surface 14*g* from the axial center 14α of the jaw cylinder 14 and causes the plate support shaft 14*a* to undergo angular displacement via the arm 14*e*, and, when the cam follower 14*d* passes the large diameter area of the endless cam surface

14*g*, the leading edge side of the plate member 14*b* becomes adjacent to or contacts the block member 14*c*.

The plate member drive cam 14*f* herein is provided such that, when the large diameter area of the endless cam surface 14*g* causes the leading edge side of the plate member 14*b* to be adjacent to or contact the block member 14*c*, an adjacency-or-contact state between the leading edge side of the plate member 14*b* and the block member 14*c* is maintainable until a rotational phase of the jaw cylinder 14 is attained where the adjacency-or-contact position sufficiently reaches the delivery mechanism 17 from a position facing the protruding position of the folding blade 13*f* of the folding cylinder 13 after the jaw cylinder 14 has further rotated. Therefore, whenever the leading edge side of the folding blade 13*f* protrudes from the outer circumferential surface of the folding cylinder 13 and the sheet S released from the paper holding pin 13*c* is protruded toward the jaw mechanism 14A of the jaw cylinder 14, the sheet S protruded by the plate member 14*b* and the block member 14*c* is gripped and folded to form the signature to be delivered to the delivery mechanism 17.

The delivery mechanism 17 sandwiches the signature delivered from the jaw cylinder 14 between the upper conveyor 17*a* and the lower conveyor 17*b* to carry the signature to the downstream side while reinforcing the fold line formed by the gripping and folding.

Note that the desired number of overlaps of the sheet S need only be pre-specified and set to an integer of one or more.

When the desired number of overlaps of the sheet S is "1", the folding device 1 need only be operated maintaining a state where the hydraulic actuated cylinders 15*f* and 15*g*, and 16*f* and 16*g* each have their output rod retracted, in other words, a state where the masking cams 15*c* and 15*d* do not mask the concave portion of the endless cam surface 15*b* of the paper holding pin drive cam 15*a* and action of this concave portion is therefore not invalidated, and the masking cams 16*c* and 16*d* do not mask the concave portion of the endless cam surface 16*b* of the folding blade drive cam 16*a* and action of this concave portion is therefore not invalidated.

That is, release of the sheet S by the paper holding pin 13*c* due to action of the small diameter area of the endless cam surface 15*b* of the paper holding pin drive cam 15*a* and separation of the sheet S from the circumferential surface of the folding cylinder 13 by the folding blade 13*f* due to action of the small diameter area of the endless cam surface 16*b* of the folding blade drive cam 16*a* are performed every one revolution of the folding cylinder 13, hence the sheet S is received, gripped, and folded in the jaw mechanism 14A of the jaw cylinder 14 to form a signature having a single sheet S folded in two, without any overlapping of sheets S at the outer circumferential surface of the folding cylinder 13. In other words, straight folding is performed.

The signature formed by the folding device 1 is delivered to the downstream side by the delivery mechanism 17 of the folding device 1.

That concludes description of the folding device according to the present embodiment made with reference to the drawings, but the folding device according to the present invention is not limited to the previously described embodiment and includes modifications satisfying the scope of the claims.

For example, outer circumferential dimensions of the cutting cylinder, the folding cylinder, and the jaw cylinder need only each be an integer multiple of the length that the continuous paper W is cut and outer circumferential dimension ratios of each of the cylinders is not limited, moreover, the number of cutting blades provided to the cutting cylinder, the number of cutting blade receivers, paper edge holding mechanisms and folding blade mechanisms provided to the folding cylinder, and the number of jaw mechanisms provided to the jaw cylinder need only each be provided in a number matching an integer multiple of the length that the continuous paper W is cut.

In addition, the cutting mechanism need not be of a cylindrical shape provided it is a mechanism capable of performing a cutting action by cooperation of the cutting blade with the cutting blade receiver provided to the folding cylinder, the folding mechanism may be a folding roller mechanism where, in place of the jaw cylinder, a pair of rollers having an axis line substantially parallel to the axis line of the folding cylinder are provided to closely approach one another, and the paper edge holding mechanism may be an appropriate holding mechanism and is not limited to a holding mechanism by a pin.

Furthermore, the number of masking cams provided to the paper edge holding mechanism operation control mechanism and the folding blade mechanism operation control mechanism is not limited to that in the above description. That is, provided that, as in the above description, a signature is produced where all of the pairs of paper edge holding mechanism and folding blade mechanism that protrude the sheet released from the folding cylinder toward the jaw cylinder overlap the same number of sheets on the outer circumferential surface of the folding cylinder and protrude the overlapped sheets released from the folding cylinder toward the jaw cylinder, in other words, where all of the pairs of paper edge holding mechanism and folding blade mechanism overlap the same number of sheets, there need only be one masking cam provided to the paper edge holding mechanism operation control mechanism and the folding blade mechanism operation control mechanism, and, when, as in the above description, only one masking cam is provided to the paper edge holding mechanism operation control mechanism and the folding blade mechanism operation control mechanism, positions of the cam followers 13*i* and 13*h* linked to the pin support shafts 13*a* and 13*b* in a parallel direction to the axial center of the pin support shafts 13*a* and 13*b* are the same. Moreover, the masking cams of the paper edge holding mechanism operation control mechanism and the folding blade mechanism operation control mechanism may be provided in a number corresponding to the number of paper edge holding mechanisms and folding blade mechanisms, and, when the masking cams are provided in an amount of the number of paper edge holding mechanisms and folding blade mechanisms as in the above description, then changing displacement timing of each of the masking cams for each pair of paper edge holding mechanism and folding blade mechanism that protrude the sheet released from the folding cylinder toward the jaw cylinder allows the number of sheets overlapped at the outer circumferential surface of the folding cylinder to be changed on a pair basis and allows signatures to be produced having different numbers of sheets overlapped for each pair of paper edge holding mechanism and folding blade mechanism.

Still further, the masking cam drive means provided to the paper edge holding mechanism operation control mechanism and the folding blade mechanism operation control mechanism is not limited to the hydraulic actuated cylinder, needing only to allow the masking cam to undergo angular displacement around the axial center of the folding blade, and may be, for example, a link mechanism or rack-and-pinion mechanism driven by a servomotor, or the like. That is, the masking cam drive means need only be a drive means capable of realizing the same operational effects as the above-mentioned hydraulic actuated cylinder.

The above description of the folding device according to the present embodiment describes an embodiment where the masking cam drive means provided to the paper edge holding mechanism operation control mechanism and the folding blade mechanism operation control mechanism is configured by a hydraulic actuated cylinder. However, the paper edge holding mechanism operation control mechanism and the folding blade mechanism operation control mechanism according to the present invention are not limited to using a hydraulic actuated cylinder. Hence, next, an embodiment where the masking cam drive means provided to the paper edge holding mechanism operation control mechanism and the folding blade mechanism operation control mechanism is configured by a link mechanism driven by a servomotor (hereinafter, referred to as "servomotor link mechanism" for convenience) is described using the drawings. Note that the embodiment below is not intended to limit the inventions set forth in the claims, and the combination of features described in the embodiment are not all necessarily indispensable for the means for solving the problem provided by the invention. Moreover, in the description below, identical symbols may be assigned to members that are identical or similar to members of the folding device provided with the hydraulic actuated cylinders described using FIGS. 1-6 (folding device 1), and a description of such members omitted.

Figure 7:
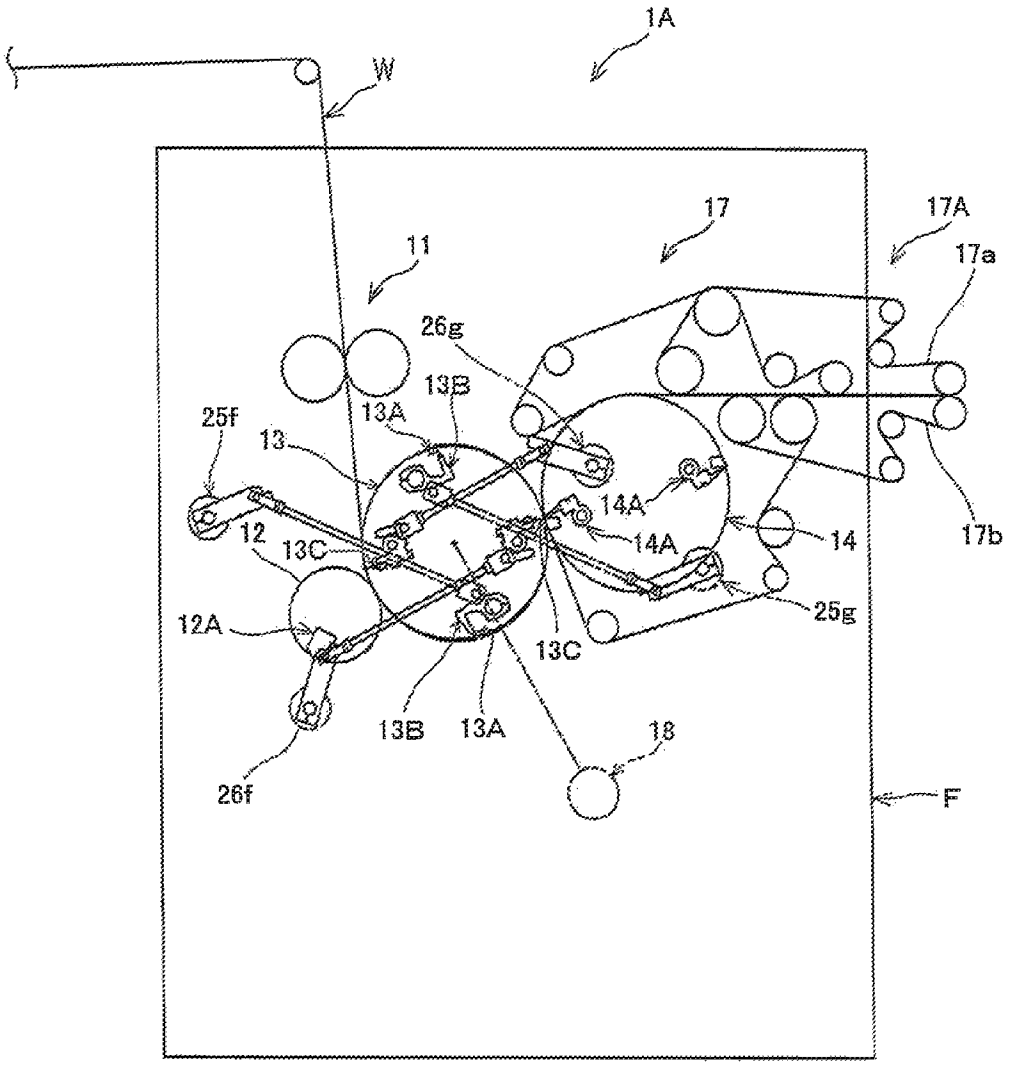
FIG. 7 is an elevation view skeleton diagram showing an overall configuration of a folding device according to another embodiment.
Figure 8:
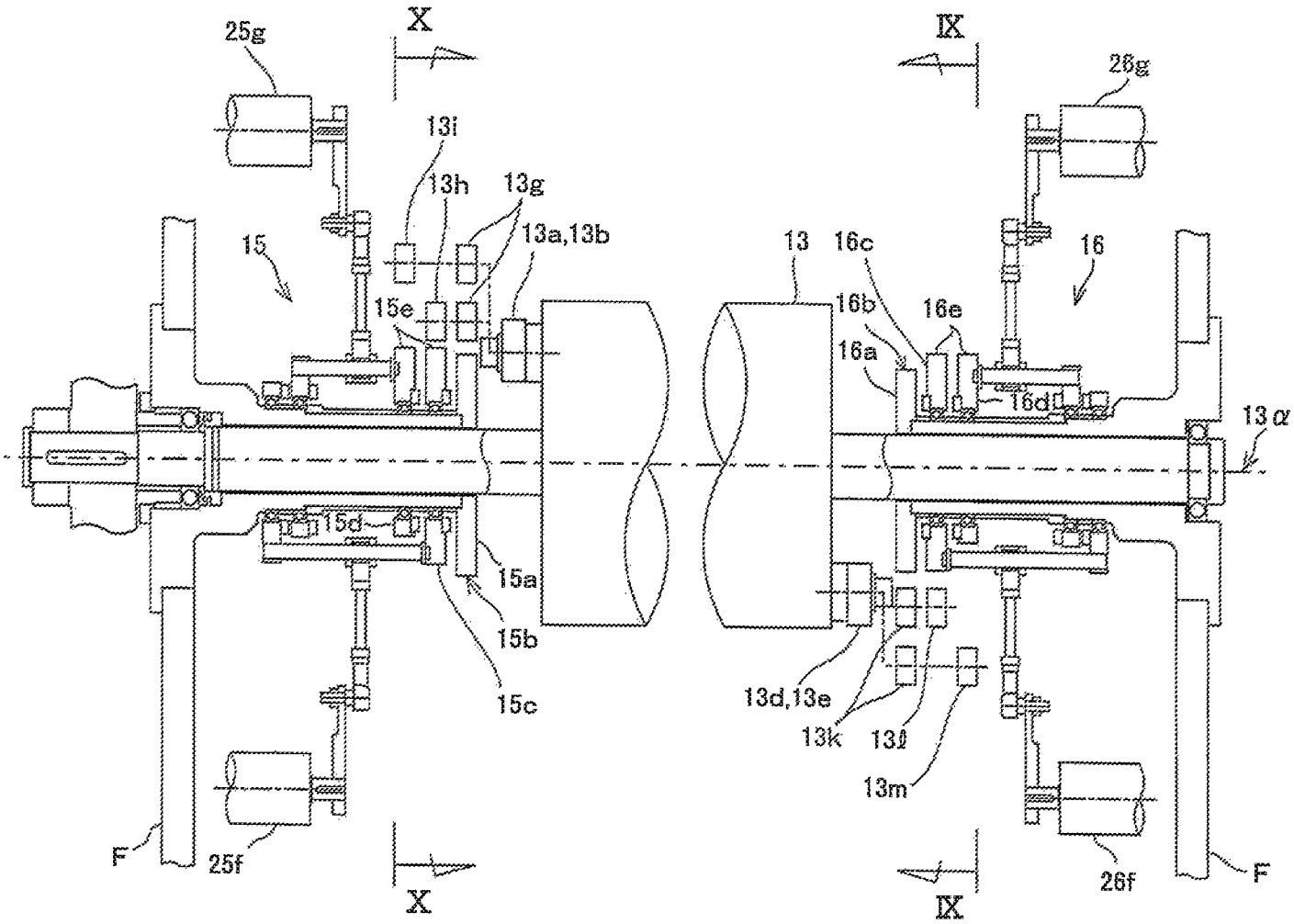
FIG. 8 is a partial cross-sectional parallel view along an axial center of the folding cylinder.
Figure 9:
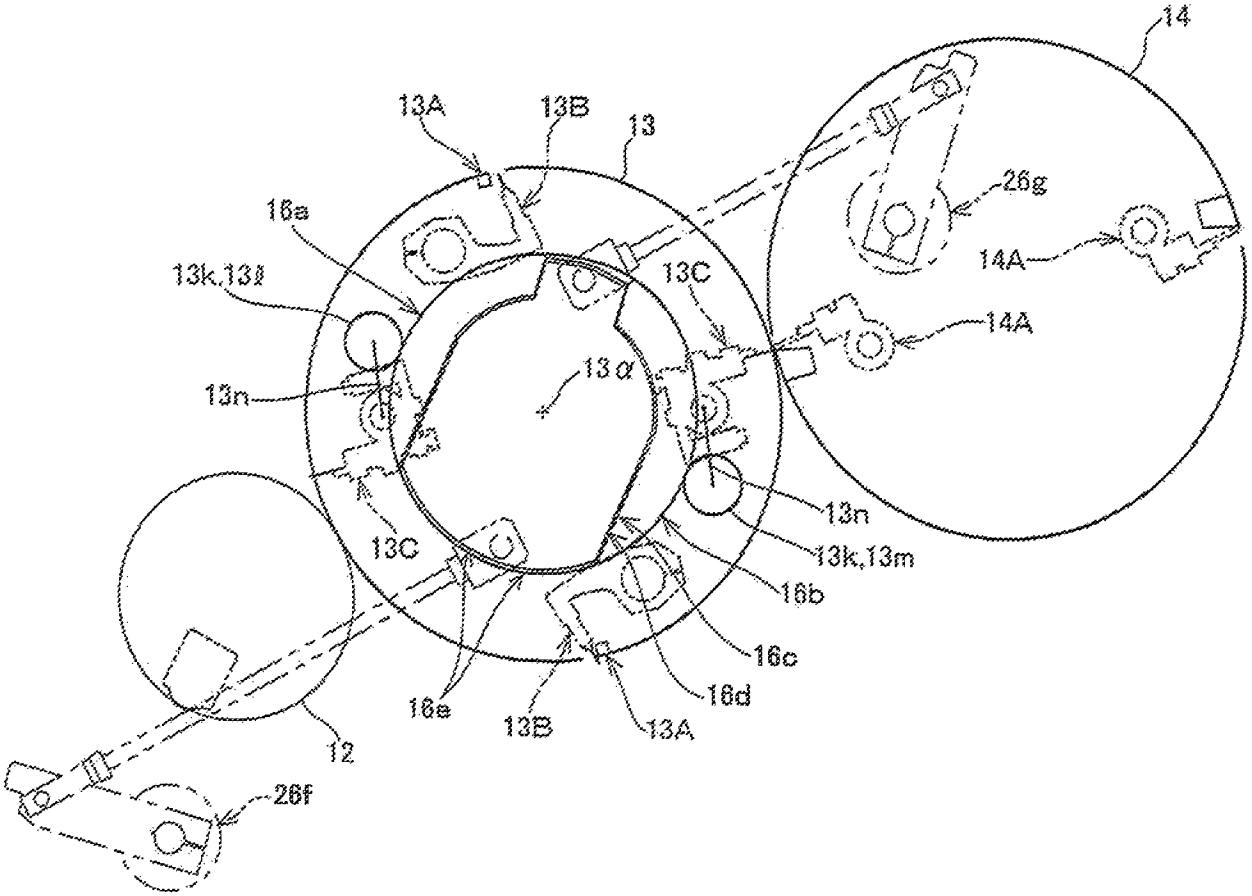
FIG. 9 is a view taken along the line IX-IX of FIG. 8 and viewed in the direction of the arrows, showing in particular a configuration of a cam and a cam follower in a folding blade mechanism operation control mechanism.
Figure 10:
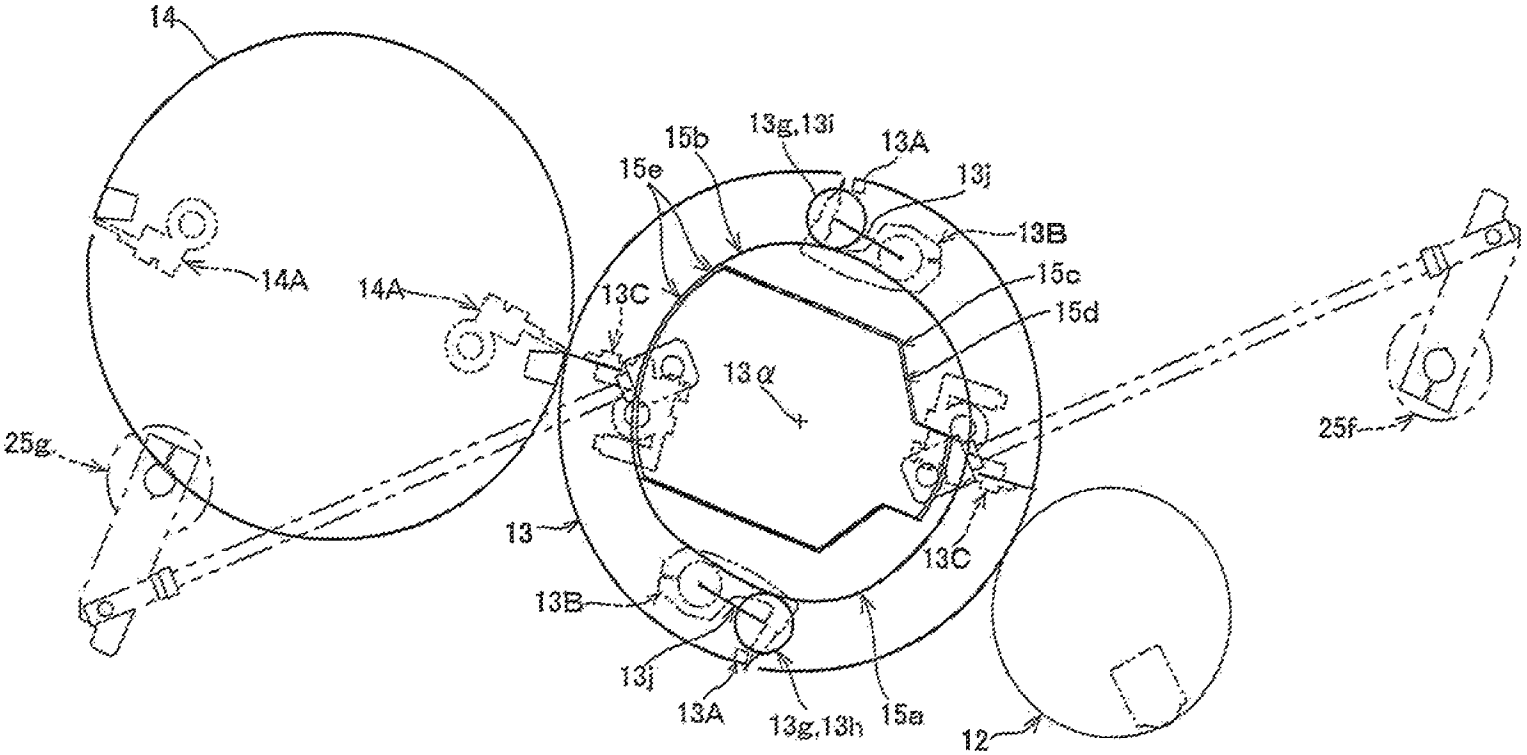
FIG. 10 is a view taken along the line X-X of FIG. 8 and viewed in the direction of the arrows, showing in particular a configuration of a cam and a cam follower in a paper edge holding mechanism operation control mechanism.
Figure 11:
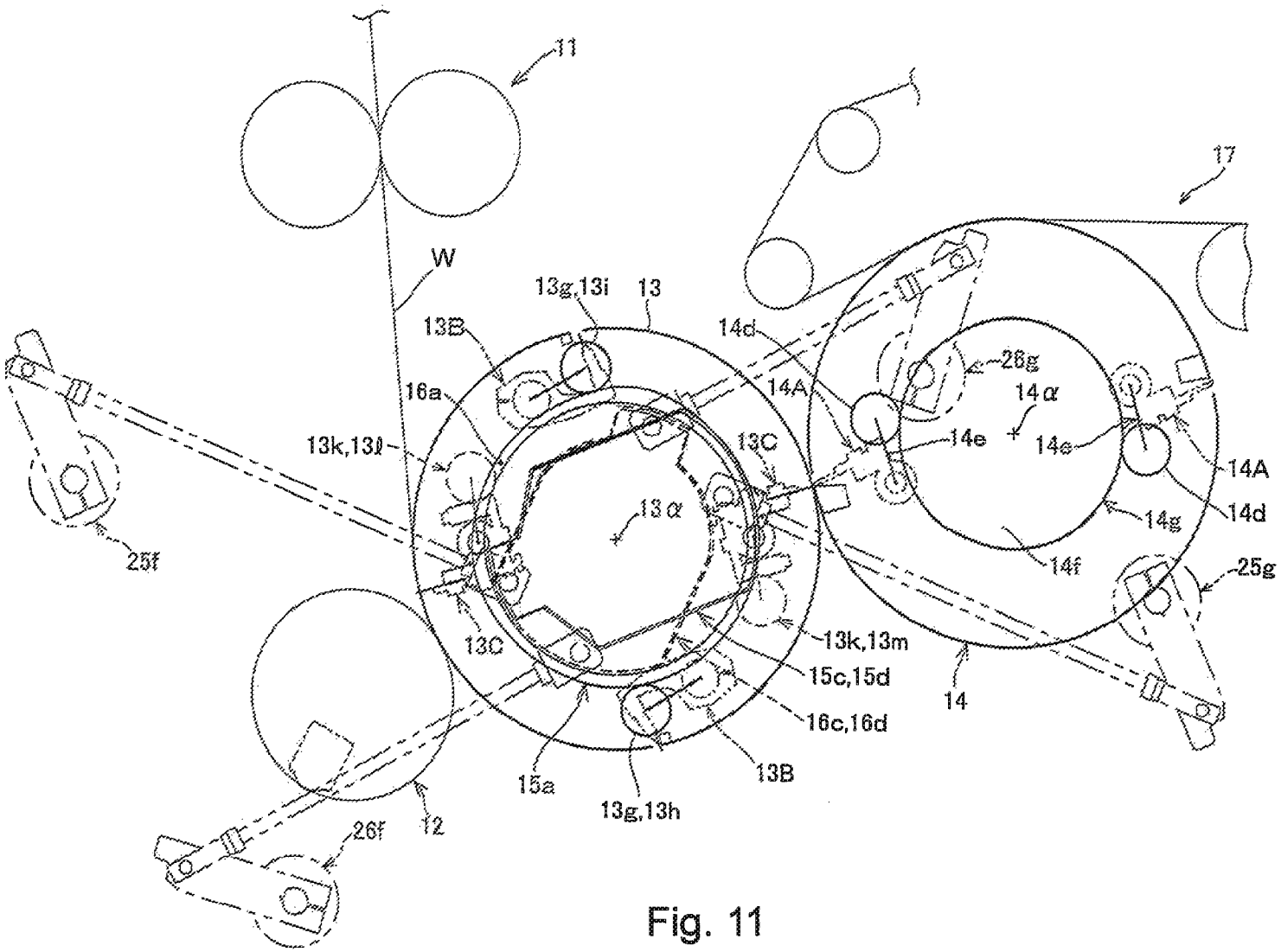
FIG. 11 is an elevation view skeleton diagram showing jointly the configuration of the cam and the cam follower in the folding blade mechanism operation control mechanism and the configuration of the cam and the cam follower in the paper edge holding mechanism operation control mechanism, and also showing jointly a configuration of a cam and a cam follower controlling operation of a jaw mechanism in the jaw cylinder.

FIG. 7 is an elevation view skeleton diagram showing an overall configuration of a folding device according to present embodiment. FIG. 8 is a partial cross-sectional parallel view along the axial center of the folding cylinder. FIG. 9 is a view taken along the line IX-IX of FIG. 8 and viewed in the direction of the arrows, showing in particular a configuration of the cam and the cam follower in the folding blade mechanism operation control mechanism. FIG. 10 is a view taken along the line X-X of FIG. 8 and viewed in the direction of the arrows, showing in particular a configuration of the cam and the cam follower in the paper edge holding mechanism operation control mechanism. FIG. 11 is an elevation view skeleton diagram showing jointly the con figuration of the cam and the cam follower in the folding blade mechanism operation control mechanism and the configuration of the cam and the cam follower in the paper edge holding mechanism operation control mechanism, and also showing jointly a configuration of the cam and the cam follower controlling operation of the jaw mechanism in the jaw cylinder.

As shown in FIG. 8, the paper edge holding mechanism operation control mechanism 15 for operating the paper edge holding mechanism 13B is provided between the folding cylinder 13 and the frame F that faces the one side surface of the folding cylinder 13. That is, the paper holding in drive cam 15*a* is provided fixed to the frame F via a shaft bearing sleeve of the folding cylinder 13. The paper holding pin drive cam 15*a* includes the endless cam surface 15*b* in which a distance from an axial center 13α of the folding cylinder 13 at which the paper holding pin 13*c* is to be operated changes in a predetermined state, and this endless cam surface 15*b* is provided disposed at a position to be rotatable and contacted by the outer circumferential surface of the cam follower 13*g* attached to the free end side of one of the arms 13*j* fixed to the one end of the pin support shafts 13*a* and 13*b*. Furthermore, the masking cams 15*c* and 15*d* are provided at a position adjacent to the paper holding pin drive cam 15*a*. The masking cams 15*c* and 15*d* each include at least the mask cam surface 15*e* that invalidates an area (small diameter area) for retracting the paper holding pin 13*c* from the outer circumferential surface of the folding cylinder 13 in the endless cam surface 15*b* of the paper holding pin drive cam 15*a*. Moreover, this mask cam surface 15*e* is capable of displacement between a state invalidating the small diameter area in the endless cam surface 15*b* of the paper holding pin drive cam 15*a* and a state not invalidating the small diameter area, and, when the mask cam surface 15*e* of the masking cams 15*c* and 15*d* is in a state of at least invalidating the small diameter area in the endless cam surface 15*b* of the paper holding pin drive cam 15*a*, this mask cam surface 15*e* is provided disposed at position to be rotatable and contacted by the outer circumferential surface of the cam followers 13*h* or 13*i* attached to the free end side of the other of the arms 13*j* fixed to the one end of the pin support shafts 13*a* and 13*b*. Moreover, in the present embodiment, the masking cam drive means for displacing the masking cams 15*c* and 15*d* is servomotor link mechanisms 25*f* and 25*g*, and is provided capable of activation by an appropriately outputted activating signal, for example, predetermined activating signal outputted from an appropriate signal output means or by satisfaction of "AND" between this activating signal and a detection signal outputted based on a detection value of the detecting means 18 for detecting the rotational phase of the folding cylinder 13. As shown in FIG. 7, when the servomotor link mechanisms 25*f* and 25*g* extend (that is, when a shaft connected to the servomotor rotates in response to drive of the servomotor, thereby causing a distance between this shaft and a place of connection of a link in the folding cylinder 13 to lengthen), the masking cams 15*c* and 15*d* each undergoes angular displacement around the axial center 13α of the folding cylinder 13, and the mask cam surface 15*e* moves to a position overlapping the small diameter area in the endless cam surface 15*b* of the paper holding pin drive cam 15*a*. In addition, as shown in FIGS. 10 and 11, when the servomotor link mechanisms 25*f* and 25*g* retract (that is, when the shaft connected to the servomotor rotates in response to drive of the servomotor, thereby causing a distance between this shaft and the place of connection of the link in the folding cylinder 13 to shorten), the masking cams and 15*d* each undergoes angular displacement around the axial center 13α of the folding cylinder 13, and the mask cam surface 15*e* moves to a position not overlapping the small diameter area in the endless cam surface 15*b* of the paper holding pin drive cam 15*a*. In other words, extension and retraction of the servomotor link mechanisms 25*f* and 25*g* causes the masking cams 15*c* and 15*d* to undergo back-and-forth angular displacement around the axial center 13α of the folding cylinder 13 and undergo displacement between a state invalidating the small diameter area in the endless cam surface 15*b* of the paper holding pin drive cam 15*a* and a state not invalidating the small diameter area.

Note that, in FIGS. 10 and 11, in order to facilitate understanding of the paper holding pin drive cam 15*a* and the masking cams 15*c* and 15*d*, a distance from the axial center 13α of the folding cylinder 13 of an area (large diameter area) for projecting the paper holding pin 13*c* from the outer circumferential surface of the folding cylinder 13 in the endless cam surface 15*b* of the paper holding pin drive cam 15*a*, and a distance from the axial center 13α of the folding cylinder 13 of the mask cam surface 15*e* of the masking cams 15*c* and 15*d* are, for convenience, shown to differ. However, in reality, both distances are provided to be equal. Similarly, for convenience, sizes of the two masking cams 15*c* and 15*d* are shown to differ, but, in reality, are the same. Moreover, an appropriate stopper (not illustrated) for limiting an amount of angular displacement of the masking cams 15*c* and 15*d* may of course be provided.

At the same time, the folding blade mechanism operation control mechanism 16 for operating the folding blade mechanism 13C is provided between the folding cylinder 13 and the frame F that faces the other side surface of the folding cylinder 13. That is, the folding blade drive cam 16*a* is provided fixed to the frame F via a shaft bearing sleeve of the folding cylinder 13. The folding blade drive cam 16*a* includes the endless cam surface 16*b* in which a distance from the axial center 13*a* of the folding cylinder 13 at which the folding blade 13*f* is to be operated changes in a predetermined state, and this endless cam surface 16*b* is provided disposed at a position to be rotatable and contacted by the outer circumferential surface of the cam follower 13*k* attached to the free end side of one of the arms 13*m* fixed to the other end of the blade support shafts 13*d* and 13*e*. Furthermore, the masking cams 16*c* and 16*d* are provided at a position adjacent to the folding blade drive cam 16*a*. The masking cams 16*c* and 16*d* each include at least the mask cam surface 16*e* that invalidates an area (small diameter area) for projecting the folding blade 13*f* from the outer circumferential surface of the folding cylinder 13 in the endless cam surface 16*b* of the folding blade drive cam 16*a*. Moreover, this mask cam surface 16*e* is capable of displacement between a state invalidating the small diameter area in the endless cam surface 16*b* of the folding blade drive cam 16*a* and a state not invalidating the small diameter area, and, when the mask cam surface 16*e* of the masking cams 16*c* and 16*d* is in a state of at least invalidating the small diameter area in the endless cam surface 16*b* of the folding blade drive cam 16*a*, this mask cam surface 16*e* is provided disposed at a position to be rotatable and contacted by the outer circumferential surface of the cam followers 13*l* or 13*m* attached to the free end side of the other of the arms 13*n* fixed to the other end of the blade support shafts 13*d* or 13*e*. Moreover, in the present embodiment, the masking cam drive means for displacing the masking cams 16*c* and 16*d* is servomotor link mechanisms 26*f* and 26*g*, and is provided capable of activation by an appropriately outputted activating signal, for example, a redetermined activating signal outputted from an appropriate signal output means or by satisfaction of "AND" between this activating signal and a detection signal outputted based on a detection value of the detecting means 18 for detecting the rotational phase of the folding cylinder 13. As shown in FIG. 7, when the servomotor link mechanisms 26*f* and 26*g* extend, the masking cams and 16*d* each undergoes angular displacement around the axial center 13α of the folding cylinder 13, and the mask cam surface 16*e* moves to a position overlapping the small diameter area in the endless cam surface 16*b* of the folding blade drive cam 16*a*. In addition, as shown in FIGS. 10 and 11, when the servomotor link mechanisms 26*f* and 26*g* retract, the masking cams 16*c* and 16*d* each undergoes angular displacement around the axial center 13α of the folding cylinder 13, and the mask cam surface 16*e* moves to a position not overlapping the small diameter area in the endless cam surface 16*b* of the folding blade drive cam 16*a*. In other words, extension and retraction of the servomotor link mechanisms 26*f* and 26*g* causes the masking cams 16*c* and 16*d* to undergo back-and-forth angular displacement round the axial center 13α of the folding cylinder 13 and undergo displacement between a state invalidating the small diameter area in the endless cam surface 16*b* of the folding blade drive cam 16*a* and a state not invalidating the small diameter area.

Note that, in FIGS. 9 and 11, in order to facilitate understanding of the folding blade drive cam 16*a* and the masking cams 16*c* and 16*d*, a distance from the axial center 13α of the folding cylinder 13 of an area (large diameter area) for retracting the folding blade 13*f* from the outer circumferential surface of the folding cylinder 13 in the endless cam surface 16*b* of the folding blade drive cam 16*a*, and a distance from the axial center 13α of the folding cylinder 13 of the mask cam surface the of the masking cams 16*c* and 16*d* are, for convenience, shown to differ. However, in reality, both distances are provided to be equal. Similarly, for convenience, sizes of the two masking cams the and 16*d* are shown to differ, but, in reality, are the same. Moreover, an appropriate stopper (not illustrated) for controlling an amount of angular displacement of the masking cams 16*c* and 16*d* may of course be provided.

Next, operation of a folding device 1A according to the present embodiment configured as described above is described.

First, operation of collect folding is described.

Prior to operation start, the servomotor link mechanisms 25*f* and 25*g*, and 26*f* and 26*g* are each set to an extended state, in other words, to a state where the masking cams 15*c* and 15*d* mask the concave portion of the endless cam surface 15*b* of the paper holding pin drive cam 15*a* to invalidate action of this concave portion, and the masking cams 16*c* and 16*d* mask the concave portion of the endless cam surface 16*b* of the folding blade drive cam 16*a* to invalidate action of this concave portion.

Next, the folding device 1A is started up.

In the folding device 1A, the cutting blade 12A of the cutting cylinder 12 and the cutting blade receiver 13A of the folding cylinder 13 engage at a facing position of the cutting cylinder 12 and the folding cylinder 13, and the cutting cylinder 12, the folding cylinder 13, and the jaw cylinder 14 rotate with an almost identical circumferential surface speed with a mutual rotational phase that enables delivery of the sheet S at the facing position of the folding cylinder 13 and the jaw cylinder 14 due to the folding blade mechanism 13C of the folding cylinder 13 and the jaw mechanism 14A of the jaw cylinder 14.

The continuous paper W that has been guided to the folding device 1A from an upstream side is pulled in by the drag roller mechanism 11 and sent to between the cutting cylinder 12 and the folding cylinder 13.

Moreover, as mentioned above, the continuous paper W is held by the paper holding pin 13*c* and cut at a certain position by engagement of the cutting blade 12A and the cutting blade receiver 13A, then, every time the folding cylinder 13 makes a half revolution in the circumferential direction, this holding of the continuous paper W due to the paper holding pin 13*c* and cutting of the continuous paper W due to engagement of the cutting blade 12A and the cutting blade receiver 13A are performed, and, every half circumferential surface of the folding cylinder 13, the sheet S is held and overlapped.

When an overlap number of the sheet S reaches a desired number, the folding cylinder 13 delivers the sheets S overlapped on its outer circumferential surface to the jaw mechanism 14A of the jaw cylinder 14. That is, when the overlap number of the sheet S reaches the desired number, a predetermined activating signal is outputted from an appropriate signal output means that detects the overlap number of the sheet S by a detecting means such as a count sensor, for example, or, in a state where this activating signal is outputted, "AND" is established between this activating signal and a detection signal based on a detection value of the detecting means 18 for detecting the rotational phase of the folding cylinder 13, whereby the servomotor link mechanisms 25*f* and 25*g* and the servomotor link mechanisms 26*f* and 26*g* retract. Retraction of the servomotor link mechanisms 25*f* and 25*g* causes the masking cams 15*c* and 15*d* to undergo angular displacement in an anticlockwise direction in FIG. 10 around the axial center 13α of the folding cylinder 13, and the mask cam surface 15*e* to deviate from the small diameter area of the endless cam surface 15*b* of the paper holding pin drive cam 15*a*, thereby validating action of this small diameter area. Similarly, retraction of the servomotor link mechanisms 26*f* and 26*g* causes the masking cams 16*c* and 16*d* to undergo angular displacement in a clockwise direction in FIG. 9 around the axial center 13α of the folding cylinder 13, and the mask cam surface 16*e* to deviate from the small diameter area of the endless cam surface 16*b* of the folding blade drive cam 16*a* thereby validating action of this small diameter area.

When action of the small diameter area of the endless cam surface 15*h* of the paper holding pin drive cam 15*a* is validated, the outer circumferential surface of the cam follower 13*a* attached to the free end side of one of the arms 13*j* fixed to one end of the pin support shafts 13*a* and 13*b* contacts this endless cam surface 15*b* to rotate, displaces the arm 13*j* according to a change in distance of the endless cam surface 15*b* from the axial center 13α of the folding cylinder 13 and causes the pin support shafts 13*a* and 13*b* to each undergo angular displacement via the arm 13*j*, and, when the cam follower 13*g* passes the small diameter area of the endless cam surface 15*b*, the paper holding pin 13*c* retracts inside from the outer circumferential surface of the folding cylinder 13. When the paper holding pin 13*c* retracts inside from the outer circumferential surface of the folding cylinder 13, the sheet S that was held in the outer circumferential surface of the folding cylinder 13 by the paper holding pin 13*c* is released.

Moreover, when action of the small diameter area of the endless cam surface 16*b* of the folding blade drive cam 16*a* is validated, the outer circumferential surface of the cam follower 13*k* attached to the free end side of one of the arms 13*n* fixed to one end of the blade support shafts 13*d* and 13*e* contacts this endless cam surface 16*b* to rotate, displaces the arm 13*n* according to a change in distance of the endless cam surface 16*b* from the axial center 13α of the folding cylinder 13 and causes the blade support shafts 13*d* and 13*e* to each undergo angular displacement via the arm 13*n*, and, when the cam follower 13*k* passes the small diameter area of the endless cam surface 16*b*, the leading edge side of the folding blade 13*f* projects from the outer circumferential surface of the folding cylinder 13. When the leading edge side of the folding blade 13*f* projects from the outer circumferential surface of the folding cylinder 13, the sheet S that was held in the outer circumferential surface of the folding cylinder 13 by the paper holding pin 1 is projected out to separate in a radial direction from the outer circumferential surface of the folding cylinder 13.

The paper holding pin drive cam 15*a* and the folding blade drive cam 16*a* herein are provided such that release of the sheet S by the paper holding pin 13*c* due to action of the small diameter area of the endless cam surface 15*b* of the paper holding pin drive cam 15*a* and separation of the sheet S from the circumferential surface of the folding cylinder 13 by the folding blade 13*f* due to action of the small diameter area of the endless cam surface 16*b* of the folding blade drive cam 16*a* are performed in substantially the same rotational phase of the folding cylinder 13, and a projection position of the folding blade 13*f* of the folding cylinder 13 in this rotational phase is provided to face a position at which the plate member 14*b* and the block member 14*c* of the jaw mechanism 14A are adjacent or contacting in a rotational phase of the jaw cylinder 14 to be described later. Therefore, as a result of the leading edge side of the folding blade 13*f* protruding from the outer circumferential surface of the folding cylinder 13, the middle part in a cutting length direction of the sheet S released from the paper holding pin 13*c* is protruded toward the jaw mechanism 14A of the jaw cylinder 14, this middle part is sandwiched by the plate member 14*b* and the block member 14*c* to be received, gripped, and folded by the jaw mechanism 14A, thereby forming the signature which is the sheet S folded in two and having a fold line formed in its middle part parallel to the axis of the jaw cylinder 14.

The jaw cylinder 14 of the folding device 1A rotates while maintaining the previously mentioned relationships of rotation direction, rotation speed, and rotation phase with the folding cylinder 13, and in each revolution, the plate member 14*b* of the jaw mechanism 14A repeats adjacency-or-contact and separation of its leading edge side with respect to the block member 14*c* of the jaw mechanism 14A. That is, the outer circumferential surface of the cam follower 14*d* attached to the free end side of the arm 14*e* fixed to one end of the plate support shaft 14*a* to which the plate member 14*b* is attached contacts the endless cam surface 14*g* of the plate member drive cam 14*f* provided fixed to the frame F facing one side surface of the jaw cylinder 14 to rotate, displaces the arm 14*e* according to a change in distance of the endless cam surface 14*g* from the axial center 14α of the jaw cylinder 14 and causes the plate support shaft 14*a* to undergo angular displacement via the arm 14*e*, and, when the cam follower 14*d* passes the large diameter area of the endless cam surface 14*g*, the leading edge side of the plate member 14*b* becomes adjacent to or contacts the block member 14*c*.

The plate member drive cam 14*f* herein is provided such that, when the large diameter area of the endless cam surface 14*g* causes the leading edge side of the plate member 14*b* to be adjacent to or contact the block member 14*c*, an adjacency-or-contact state between the leading edge side of the plate member 14*b* and the block member 14*c* is maintainable until a rotational phase of the jaw cylinder 14 is attained where the adjacency-or-contact position sufficiently reaches the delivery mechanism 17 from a position facing the protruding position of the folding blade 13*f* of the folding cylinder 13 after the jaw cylinder 14 has further rotated. Therefore, whenever the leading edge side of the folding blade 13*f* protrudes from the outer circumferential surface of the folding cylinder 13 and the sheet S released from the paper holding pin 13*c* is protruded toward the jaw mechanism 14A of the jaw cylinder 14, the sheet S protruded by the plate member 14*b* and the block member 14*c* is gripped and folded to form the signature to be delivered to the delivery mechanism 17.

The delivery mechanism 17 sandwiches the signature delivered from the jaw cylinder 14 between the upper conveyor 17*a* and the lower conveyor 17*b* to carry the signature to the downstream side while reinforcing the fold line formed by the gripping and folding.

Note that the desired number of overlaps of the sheet S need only be pre-specified and set to an integer of one or more.

When the desired number of overlaps of the sheet S is "1", the folding device 1A need only be operated maintaining a state where the servomotor link mechanisms 25*f* and 25*g*, and 26*f* and 26*g* are each retracted, in other words, a state where the masking cams 15*c* and 15*d* do not mask the concave portion of the endless cam surface 15*b* of the paper holding pin drive cam 15*a* and action of this concave portion is therefore not invalidated, and the masking cams 16*c* and 16*d* do not mask the concave portion of the endless cam surface 16*b* of the folding blade drive cam 16*a* and action of this concave portion is therefore not invalidated.

That is, release of the sheet S by the paper holding pin 13*c* due to action of the small diameter area of the endless cam surface 15*b* of the paper holding pin drive cam 15*a* and separation of the sheet S from the circumferential surface of the folding cylinder 13 by the folding blade 13*f* due to action of the small diameter area of the endless cam surface 16*b* of the folding blade drive cam 16*a* are performed every one revolution of the folding cylinder 13, hence the sheet S is received, gripped, and folded in the jaw mechanism 14A of the jaw cylinder 14 to form a signature having a single sheet S folded in two, without any overlapping of sheets S at the outer circumferential surface of the folding cylinder 13. In other words, straight folding is performed.

The signature formed by the folding device 1A is delivered to the downstream side by the delivery mechanism 17 of the folding device 1A.

That concludes description of the folding device 1A having the masking cam drive means provided to the paper edge holding mechanism operation control mechanism and the folding blade mechanism operation control mechanism configured as the link, mechanism driven by the servomotor (servomotor link mechanism), made with reference to the drawings.

Configuring the drive means of the masking cam as a servomotor link mechanism rather than as a hydraulic actuated cylinder (for example, an air cylinder) allows suppression of drive noise, longer operating life, and increased response speed to be achieved in the folding vice.

That is, using a servomotor as the drive means allows generation of collision noise caused by drive of a cylinder (for example, collision noise between the stopper provided for position-determining of the output rod and the cylinder) to be avoided.

Moreover, using a servomotor as the drive means allows the need to improve strength of the device to prevent breakage of the device overall due to vibration arising in response to operation of the cylinder to be reduced, and, in the case that other configuration is the same, allows longer operating life of the device to be attained than when using a cylinder.

In addition, using a servomotor as the drive means allows response speed to be increased over the case of using a cylinder or direct-acting motor (linear actuator).

Furthermore, using a servomotor as the drive means has the merit that position can be determined using only an encoder, hence fewer kinds of brackets need be used compared to the case of cylinder drive requiring a stopper and so on for position adjustment.

Note that although not specifically referred to in the description of the aforementioned embodiments, as shown by the fact that different shapes of masking cams 15*c* and 15*d* are indicated in, for example, FIGS. 5 and 10, the various cams may be of any shape provided the shape enables each of the aforementioned operations to be realized.

Moreover, although not specifically referred to in the description of the aforementioned embodiments, the folding device according to the present embodiment receives operation commands for operating the various mechanisms according to different purposes from a computer (not shown in the drawings) provided internal or externally of the folding device.

This invention may be utilized as a folding device for producing a signature from a print product printed on a continuous paper, and is particularly appropriate to be utilized as a folding device for producing a signature from a print product printed on a continuous paper by a digital device.

What is claimed is:

1. A folding device for cutting and folding a continuous paper, comprising:

a cutting mechanism including a cutting blade;

a folding cylinder including a folding blade mechanism and a paper edge holding mechanism; and a folding mechanism for receiving and folding at least one sheet released by the folding cylinder, the folding device comprising:

a signal output part for outputting an activating signal when the number of the sheets overlapped on an outer circumferential surface of the folding cylinder reaches a desired number, a folding blade mechanism operation control mechanism for operating the folding blade mechanism provided in the folding cylinder; and a paper edge holding mechanism operation control mechanism for operating the paper edge holding mechanism provided in the folding cylinder, wherein the folding blade mechanism operation control mechanism and the paper edge holding mechanism operation control mechanism each comprise:

a drive cam provided fixed between a frame that rotatably supports the folding cylinder and a side surface of the folding cylinder, the drive cam including an endless cam surface in which a distance from an axial center of the folding cylinder changes in a predetermined state;

a masking cam capable of angular displacement around an axial center of the folding cylinder, the masking cam including a mask cam surface for invalidating a small diameter area of the endless cam surface of the drive cam when the mask cam surface overlaps the small diameter area; and a masking cam drive means for causing angular displacement of the masking cam around the axial center of the folding cylinder from a state that the small diameter area of the endless cam surface of the drive cam is overlapped by the mask cam surface of the masking cam to a state that the small diameter area of the endless cam surface of the drive cam is not overlapped by the mask cam surface of the masking cam based on the activating signal outputted from the signal output part;

wherein the folding blade mechanism operation control mechanism and the paper edge holding mechanism operation control mechanism each have a plurality of the masking cams provided, and each have the masking cam drive means provided such that each of the respective masking cams can be separately driven.

2. The folding device according to claim 1, wherein the folding device further comprises a detecting means which is configured to be capable of detecting a rotational phase of the folding cylinder, and each of the masking cam drive means of the folding blade mechanism operation control mechanism and the paper edge holding mechanism operation control mechanism is configured to cause angular displacement of the masking cam around the axial center of the folding cylinder when a detection value of the detecting means matches a predetermined rotational phase value of the folding cylinder and the activating signal is outputted.

3. The folding device according to claim 1, wherein a same number of masking cams are provided in each of the folding blade mechanism operation control mechanism and the paper edge holding mechanism operation control mechanism as there are folding blade mechanism and paper edge holding mechanism provided in the folding cylinder.

4. The folding device according to claim 1, wherein the folding blade mechanism includes: a blade support shaft which is provided to the folding cylinder so as to be parallel to an axis direction of the folding cylinder; a folding blade which is attached to the blade support shaft; a first cam follower which is connected to the blade support shaft so as to contact with the endless cam surface of the drive cam of the folding blade mechanism operation control mechanism; and a second cam follower which is connected to the blade support shaft so as to contact with the mask cam surface of the masking cam of the folding blade mechanism operation control mechanism, and the folding blade mechanism is configured such that the folding blade operates by the first cam follower of the folding blade mechanism operation control mechanism undergoing displacement along the small diameter area of the endless cam surface of the drive cam in the state that the small diameter area of the endless cam surface of the drive cam of the folding blade mechanism operation control mechanism is not overlapped by the mask cam surface of the masking cam of the folding blade mechanism operation control mechanism, and the paper edge holding mechanism includes: a pin support shaft which is provided to the folding cylinder so as to be parallel to an axis direction of the folding cylinder; a paper holding pin which is attached to the pin support shaft; a first cam follower which is connected to the pin support shaft so as to contact with the endless cam surface of the drive cam of the paper edge holding mechanism operation control mechanism; and a second cam follower which is connected to the pin support shaft so as to contact with the mask cam surface of the masking cam of the paper edge holding mechanism operation control mechanism, and the paper edge holding mechanism is configured such that the paper holding pin operates by the first cam follower of the paper edge holding mechanism operation control mechanism undergoing displacement along the small diameter area of the endless cam surface of the drive cam in the state that the small diameter area of the endless cam surface of the drive cam of the paper edge holding mechanism operation control mechanism is not overlapped by the mask cam surface of the masking cam of the paper edge holding mechanism operation control mechanism.

* * * * *